US005465947A

United States Patent [19]

Okumura et al.

[11] Patent Number: 5,465,947

[45] Date of Patent: Nov. 14, 1995

[54] APPARATUS FOR DISCHARGING SHEETS FROM A SORTER

[75] Inventors: Keiji Okumura; Takeshi Aoki; Yoshio Sugishima; Satoru Hayama; Keiichi Taguchi; Yuichiro Iwase; Noriaki Okamoto, all of Osaka, Japan

[73] Assignee: Mita Industrial Co., Ltd., Osaka, Japan

[21] Appl. No.: 214,452

[22] Filed: Mar. 18, 1994

[30] Foreign Application Priority Data

Mar. 23, 1993 [JP] Japan ..... 5-064420

[51] Int. Cl.[6] ..... B42C 1/12; B65H 31/30

[52] U.S. Cl. ..... 270/58; 270/53; 414/790.2

[58] Field of Search ..... 270/53, 58; 271/292, 271/293; 355/323, 324; 414/790.2

[56] References Cited

U.S. PATENT DOCUMENTS

| | | | |
|---|---|---|---|
| 3,995,748 | 12/1976 | Looney | 270/53 X |
| 4,295,733 | 10/1981 | Janssen et al. | 370/58 X |
| 4,368,972 | 1/1983 | Naramore | 271/292 X |
| 4,444,491 | 4/1984 | Rinehart et al. | 270/53 X |
| 4,588,070 | 5/1986 | Smith | 414/790.2 X |
| 4,811,048 | 3/1989 | Ishikawa et al. | 355/324 X |
| 4,946,152 | 8/1990 | Ishikawa et al. | 270/58 X |
| 5,186,445 | 2/1993 | Nakanishi et al. | 270/53 |
| 5,201,503 | 4/1993 | Matsui et al. | 270/58 X |
| 5,384,634 | 1/1995 | Takehara et al. | 270/53 X |
| 5,407,186 | 4/1995 | Hayama et al. | 270/53 |

FOREIGN PATENT DOCUMENTS

| | | | |
|---|---|---|---|
| 57-63561 | 4/1982 | Japan . | |
| 61-286859 | 12/1986 | Japan | 355/323 |
| 63-165270 | 7/1988 | Japan . | |
| 1-231758 | 9/1989 | Japan . | |
| 1-231759 | 9/1989 | Japan . | |
| 1-231767 | 9/1989 | Japan . | |
| 1-231757 | 9/1989 | Japan . | |
| 1-231756 | 9/1989 | Japan . | |
| 1-231764 | 9/1989 | Japan . | |
| 4-286571 | 10/1992 | Japan | 271/292 |
| 4-341458 | 11/1992 | Japan . | |

*Primary Examiner*—John E. Ryznic
*Attorney, Agent, or Firm*—Beveridge, DeGrandi, Weilacher & Young

[57] ABSTRACT

A sheet stack handling apparatus discharges sheet stacks from a bin of a sorter disposed on the side of an image forming apparatus, and includes a sheet stocker, a sheet stack transporting route, and a sheet grasping mechanism. The stack handling or discharge apparatus is disposed on the front side of the sorter. The sheet stocker is disposed in the bottom of the discharging apparatus and stores the sheet stacks. The sheet stack transporting route is provided in the discharging apparatus and extends laterally from the side of the bin and downward to the sheet stacker. The sheet stack grasping mechanism is disposed under the sheet stack transporting route. The sheet stack grasping mechanism grasps a sheet stack in a bin of the sorter, then moves length-wise away from the image forming apparatus, and then moves width-wise to transfer the stack from the bin into the sheet stocker.

41 Claims, 28 Drawing Sheets

APPARATUS FOR DISCHARGING SHEETS FROM A SORTER

CROSS REFERENCE TO RELATED APPLICATIONS

This application is related to application Ser. No. 08/028,032, now U.S. Pat. No. 5,377,972, and application Ser. No. 08/053,952, now U.S. Pat. No. 5,407,186.

BACKGROUND OF THE INVENTION

The present invention relates to a sheet discharging apparatus, and more specifically, to an apparatus for discharging sheet stacks from a sorter connected with an image forming apparatus.

Japanese Patent Laying Open Gazette No. 231757/1989 discloses a sorter which includes a plurality of vertically movable bins storing sheet stacks discharged from a copying machine through a sorter inlet. A stapler is provided at the sorter inlet to staple sheet stacks in the bins.

However, since the sorter is not provided with a sheet discharging apparatus to discharge the sheet stacks from the bins, it is impossible to automatically finish all the required copies if the number of copies is larger than the number of the bins. Because, all the bins have been filled up with sheet stacks before the required number of copies are made. So, to finish a great number of copies, an operator must manually take out the stacks from the bins when the stacks fill up the bins.

Japanese Patent Laying Open Gazette No. 165270/1988 discloses a sorter connected with an image forming apparatus, in which a stapler is provided downward apart from a sorting unit and a unit for storing stapled stacks is disposed under the stapler. In the stapling operation, a stack of sheets once sorted by the sorting unit is transported to the stapler, where the stapler staples the fed stack and then discharges it into the lower storing unit. This apparatus can handle a number of sheet stacks to staple which is greater than the number of bins in the sorting unit.

However, the position of the stapler under the bins makes it difficult to remove the stapled stacks from the storing unit.

In order to overcome the problems of both antecedent sorters, the inventors of the present invention have developed a sorter having a sheet stack discharging apparatus which is provided in the front of the sorter. See U.S. co-pending application Ser. No. 08/053,952. The sorter can handle a number of sheet stacks greater than the number of bins, and it facilitates easy removal of stapled stacks from the sorter by providing the sheet stack discharging apparatus in the front of the sorter.

This sheet stack discharging apparatus has a hand mechanism for taking out the sheet stacks from the bins, and the hand mechanism is provided above a sheet transporting route, between the bins and the storing portion. The position of the hand mechanism makes the sheet stack discharging apparatus inconveniently tall.

This sorter has an opening on the front side, or operator side, of the sorter through which stapled stacks of sheets are removed from the sorter by the sheet stack discharging apparatus. The bins of the sorter stacked in the vertical direction are vertically moved by a mechanism which includes a pair of rotatable rods extending vertically and having a special helical groove on their surface.

The copying-machine-end of the bins engage the groove of the vertical rotable rods. Rotation of the rods move the bins up and down. There is a gap which is an opening between the bins and the stapler, and it is required to avoid interference with the driving mechanism, including the vertical rods, when the sheet stacks are removed by the hand mechanism of the sheet stack discharging apparatus. This space makes the sorter bulky.

SUMMARY OF THE INVENTION

It is an object of the present invention to reduce a height of a sheet stack discharging apparatus which is disposed in the front of a sorter.

It is another object of the present invention to reduce the size of the sorter, in front of which the discharging apparatus is disposed.

A sheet stack discharging apparatus according to an aspect of the present invention discharges sheet stacks from a bin of a sorter disposed on the side of an image forming apparatus, and includes a sheet stacker, a sheet transporting route, a sheet grasping mechanism and a sheet nipping mechanism.

The discharging apparatus is disposed on the front side of the sorter. The sheet stocker is disposed in the bottom of the apparatus for storing the sheet stacks. The sheet stack transporting route is provided in the case and extends laterally from the side of the bin and downward to the sheet stocker. The sheet stack grasping mechanism is for grasping a sheet stack in a bin of a sorter and guiding it into the transporting route, and is disposed under the sheet stack transporting route and across from the sorter. Once the sheet stack has been guided to the transporting route by the sheet stack grasping mechanism, a sheet stack nipping mechanism is provided to forward the sheet stack sorter through the transporting route.

Because the sheet stack grasping mechanism is disposed under the sheet stack transporting route, the size of the sheet stack discharging apparatus is reduced, relaxing space restrictions.

A sheet stack discharging apparatus according to another aspect discharges sheet stacks from a bin of a sorter disposed on the side of an image forming apparatus, and includes a sheet stocker and a sheet stack grasping mechanism.

The discharging apparatus is disposed on the front side of the sorter. The sheet stack grasping mechanism is for grasping sheet stacks from a bin of the sorter, and is movable in two directions.

The sheet stack grasping mechanism grasps a sheet stack in a bin of the sorter, it then moves in the length-wise direction away from the image forming apparatus, and then it moves in the width-wise direction relaying it into the transporting route. This double movement allows the sheet stack grasping mechanism to avoid the vertical disposed bin driving mechanism of the sorter. It thereby prevents damage to the sheet stack.

Accordingly, the gap between the bins and the stapler of a sorter becomes unnecessary, and the bins can be located close to the stapler. It thereby reduces the size of a sorter.

The foregoing and other objects and advantages of the present invention will be fully apparent from the following detailed description.

DESCRIPTION OF THE PREFERRED EMBODIMENTS

Overall Structure and Copying Machine Body

Figure 1:
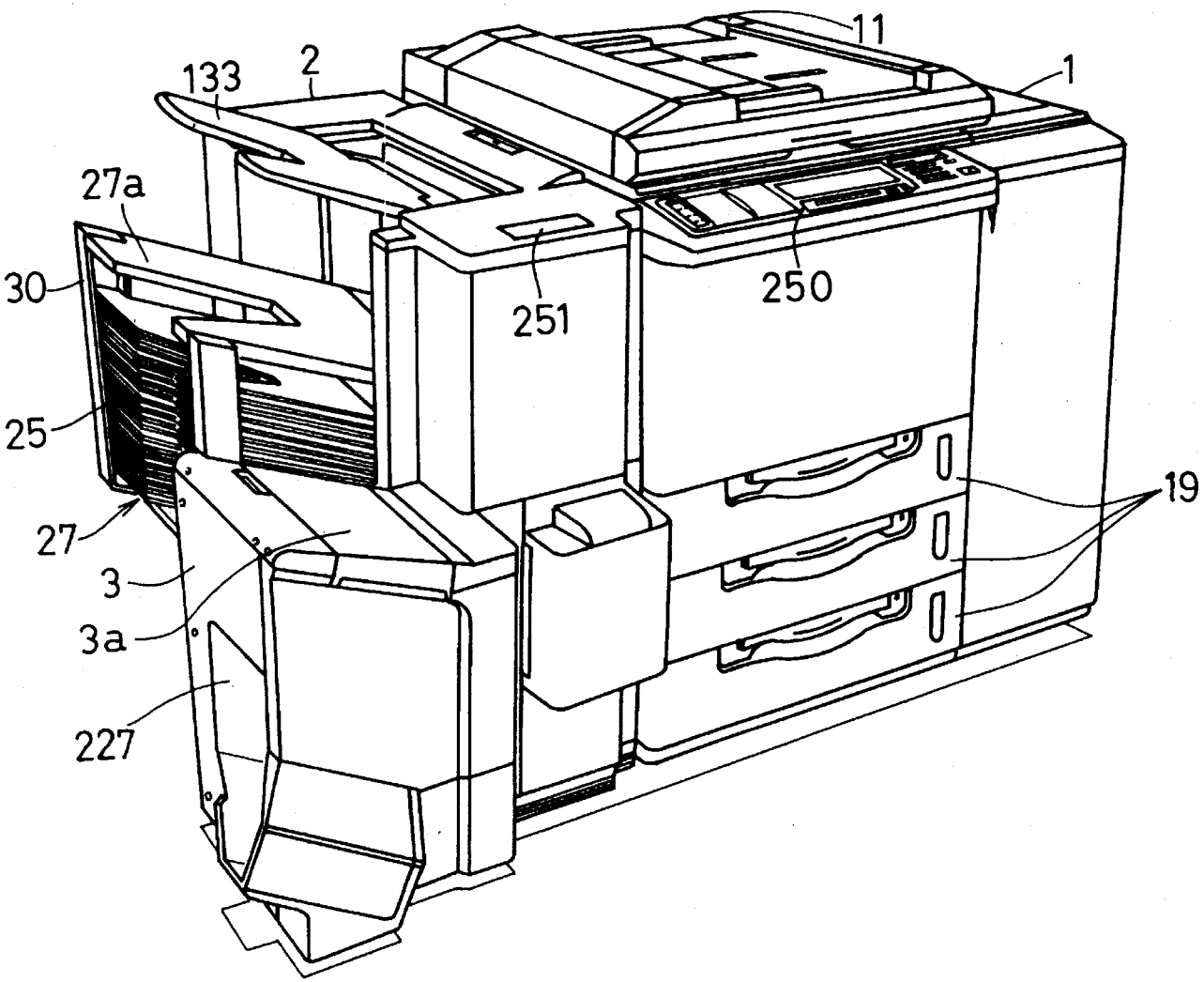
FIG. 1 is a schematic perspective view showing a copying machine according to an embodiment of the present invention.
Figure 2:
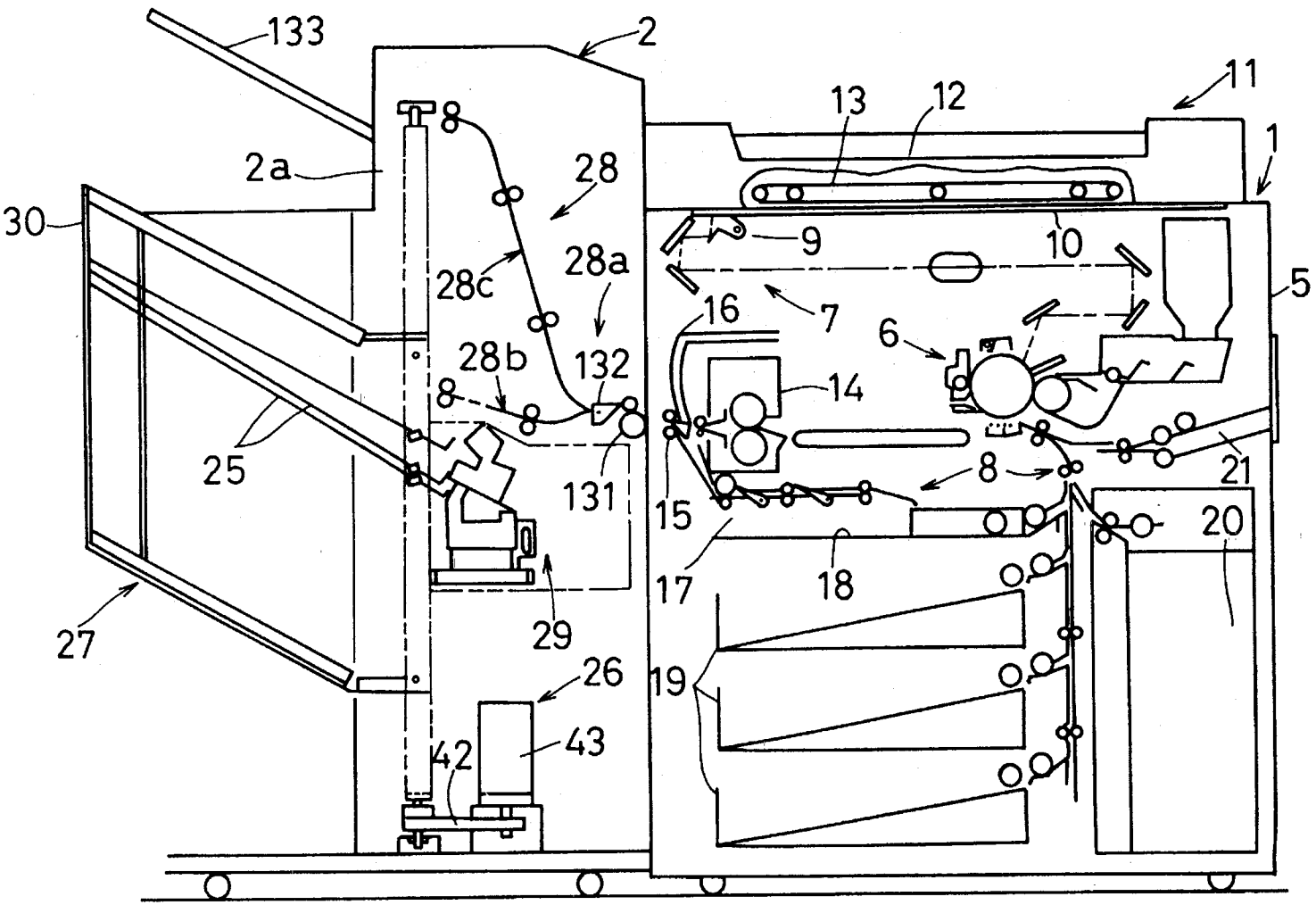
FIG. 2 is a schematic vertical section view of the above copying machine.

FIGS. 1 and 2 show an overall structure of a copying machine according to an embodiment of the present invention.

Referring to FIG. 1, the copying machine includes a copying machine body 1, a sorter 2 incorporating a stapler (referred to as a sorter hereinafter) disposed on the left side of the copying machine body 1, and a sheet stacker 3 (referred to as a multistacker hereinafter) disposed on the front side of the sorter 2 (on the operator side).

Referring to FIG. 2, the copying machine body 1 includes a case 5, an image forming unit 6 disposed in a central portion of the case 5, an original scanner 7 disposed above the image forming unit 6, and a sheet transport unit 8 through which sheets are supplied to and discharged from the image forming unit 6.

The image forming unit 6 includes a photoconductive drum disposed in the middle, and a charger, a developing unit, a transfer unit, a paper separator, and a cleaning unit disposed around the photoconductive drum.

The original scanner 7 includes an optical exposure system 9 disposed above the image forming unit 6, an original support 10 disposed over the optical exposure system 9, and an automatic original feeder 11 provided on the original support 10. The automatic original feeder 11 includes an original locating portion 12 provided on an upper surface of the feeder case, and an original transporting system 13 disposed inside the case and having an original transporting belt and associated elements. The sheet transport unit 8 includes a sheet supplying path to the right side of the image forming unit 6, and a sheet discharging path on the left side thereof. A fixing unit 14 is provided in the sheet discharging path.

On the outlet-side of the fixing unit 14, there are provided discharge rollers 15 for discharging sheets to the sorter 2, and a sheet reversing device 16. In the lower part of the case 5, there are provided a middle transporting path 17 for transporting sheets from the sheet reversing device 16, and a middle tray 18 which stores the reversed sheets. In the lower portion of the middle tray 18, a plurality of feeding cassettes 19 are vertically disposed. In the right lower portion of the case 5, there is disposed a feeding deck 20 for continuously supplying sheets. A feeding path 21 is disposed above the feeding deck 20.

Sorter

The sorter 2 includes a bin unit 27 including a plurality of bins 25 and a driving mechanism 26 driving the bins 25 in the vertical direction a transporting unit 28 disposed between the copying machine body i and the bin unit 27, for transporting the sheets from the copying machine body 1 to the bin unit 27; and a processing unit 29 disposed under the transporting unit 28 on the sheet-supplying side of the bin unit 27 (on the copying machine body 1). The bin unit 27 has a supporting frame 30 supporting the ends of the plurality of bins 25 on the sheet-discharging side.

Figure 3:
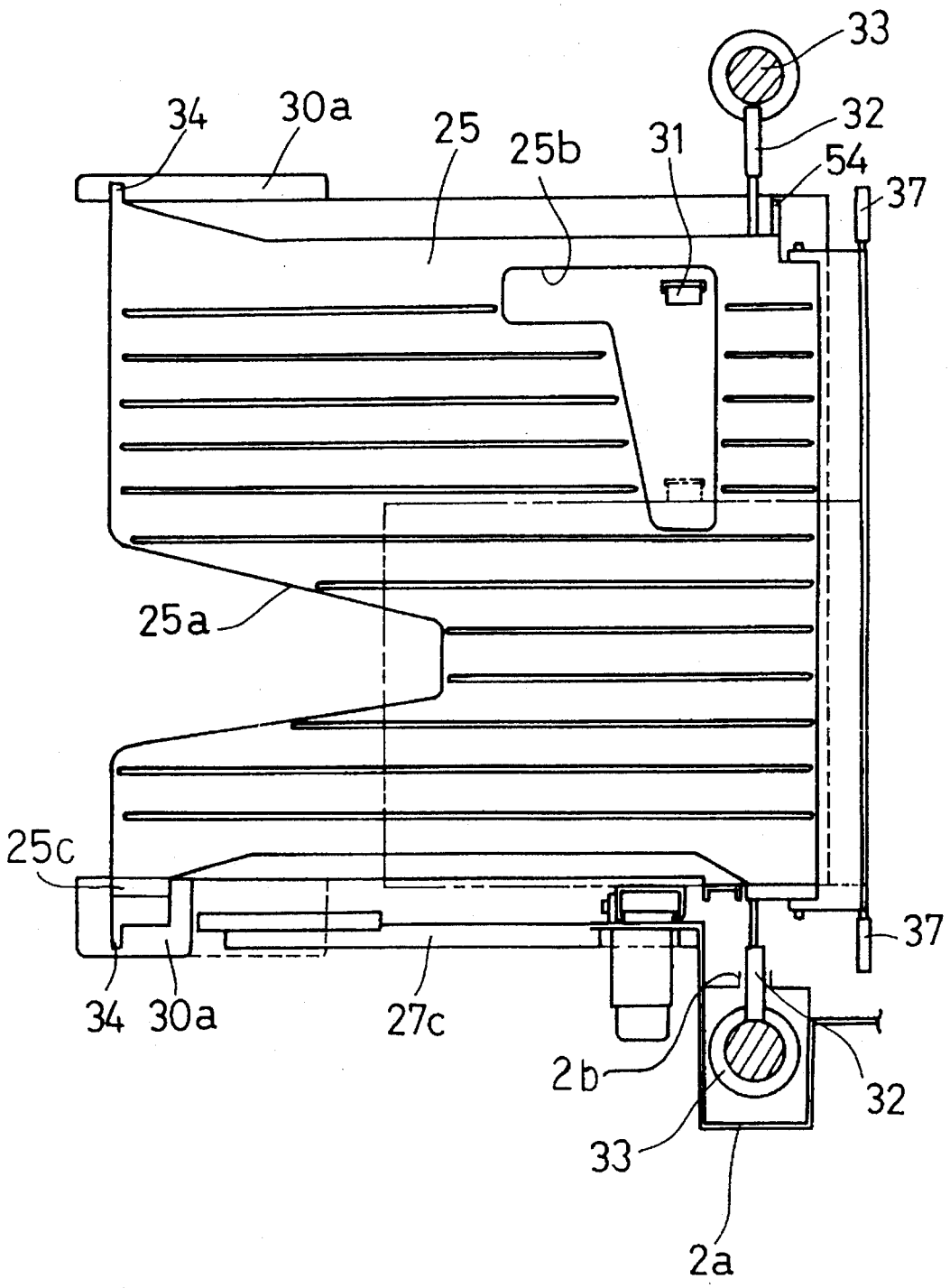
FIG. 3 is a plan view showing a bin in a sorter of the above copying machine.

Each bin 25 is a tray-like member as shown in FIG. 3. Each bin 25 has a cutout 25*a* for easy sheet removal. The cutout 25*a* is formed from the edge of the bin 25, on the sheet discharging side to the inside thereof. Also formed in the bin 25 is, a vertically penetrating opening 25*b* from which extends a lateral guide member 31. The guide member 31 is for moving the sheets toward the front side and which is disposed to be movable on the rear side (of the machine). The opening 25*b* extends in the lateral direction to allow for lateral movement of the bin 25. This lateral movement refers to a direction directly away and toward the copy machine body. The opening 25*b* also extends in the front-to-back direction to allow for frontward and backward movement of the lateral guide member 31. Trunnions 32 project outward from both the front and back edges and are positioned near the sheet supplying side of the bin 25(on the copying machine body 1 side). The trunnions 32 engage the grooves 33*a* of the cams 33 forming of the driving mechanism 26. In addition, there are also tab projections 34 which project outward from the front and back edges of the bin 25 and are positioned along the edge opposite the sheet supply side. The bins 25 are flared upward at a winged portion 25*c* near the tab extension 34. The projections 34 engage slots in a holder 30*a* formed in the supporting frame 30. Thus, the right and left sides of the bins 25 are respectively supported by the supporting frame 30 on their far edge (with respect to the image forming machine), and by the cam 33 on their opposite edge. The bins 25 are inclined such that their far ends are higher than their sheet supply side shown in FIG. 2.

Figure 4:
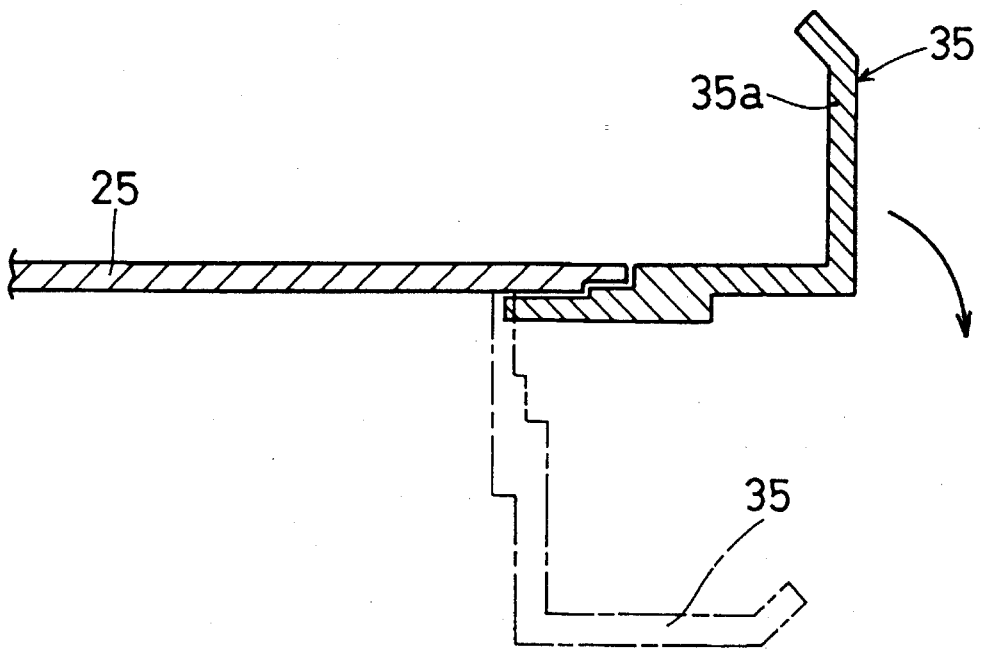
FIG. 4 is a partial section view of the above bin.
Figure 5:
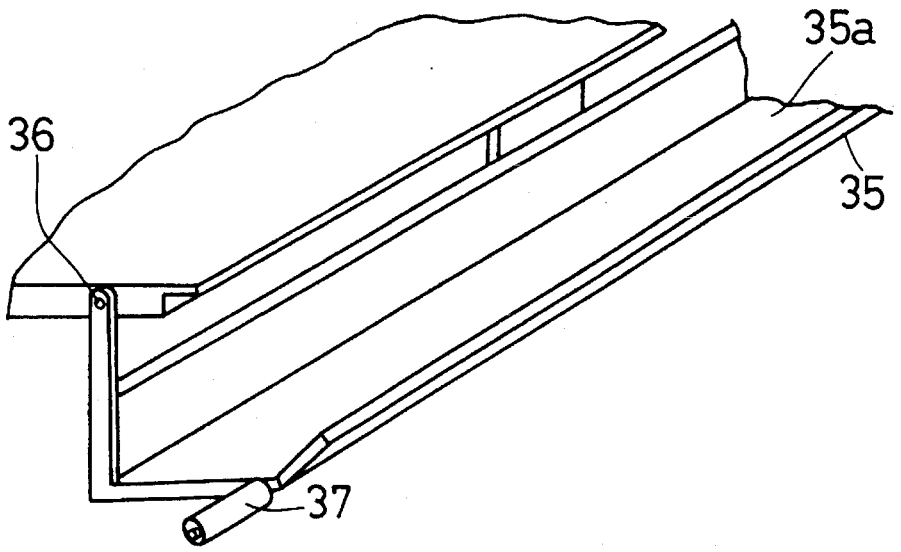
FIG. 5 is a partial perspective view of the above bin.

Referring to FIGS. 4 and 5, an L-shaped stop gate 35 is mounted to the end of the bin 25 on the copying machine body 1 side. The stop gate 35 is rotatably supported to both ends of the bins 25 by pins 36. The stop gate 35 is movable between a closed position indicated by a solid line in FIG. 4 and a open position indicated by a one-dotted line in the figure. In the closed position, a wall 35*a* of the stop gate 35 prevents the sheets from falling out of the tray, and the trailing edges of the sheets stored rest against it in the bin 25. In addition, a guide roller 37 is rotatably provided at the upper end of the wall 35*a* of the stop gate 35 as shown in FIGS. 3 and 5. The stop gate 35 is kept in the closed position indicated by the solid line in FIG. 4 by an impelling member such as a spring (not shown).

Figure 6:
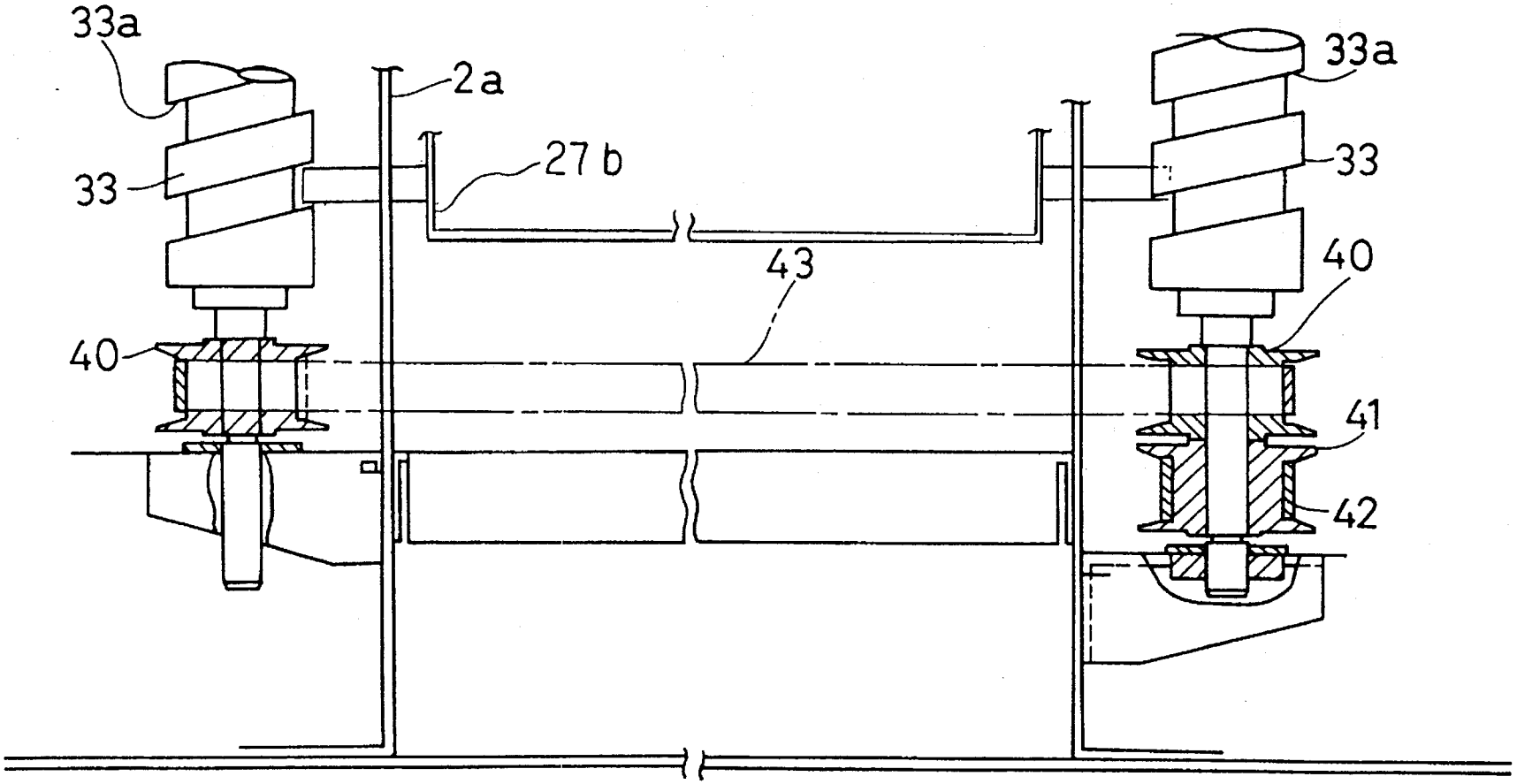
FIG. 6 is a side view showing a mechanism for driving the above bin.

The driving mechanism 26 of the bin unit 27 includes a pair of cams 33 disposed on the front and rear ends of the bins 25 on the copying machine body 1 side, opposing the trunnions 32. The cams 33 have helical grooves 33*a* on their respective surfaces, each cam 33 is vertically disposed in the sorter 2. The upper and lower ends of each cam 33 is rotatably supported within the frame 2*a* of the sorter 2, and a pulley 40 is fixed to the lower end thereof as enlargedly shown in FIG. 6. A drive pulley 41 is fixed to the lower end of the rear cam 33. A drive motor 43 (referring to FIG. 2) is connected to the drive pulley 41 by a belt 42 and other associated elements.

The pitch of the grooves 33*a* at the upper and lower portions of the cams 33 are low, and the bins 25 moved thereupon are spaced close together. However, the pitch of the grooves 33*a* at the central portion of the cams 33 is larger such that the spacing of the bins 25 which oppose the processing unit 29 is larger.

Figure 7:
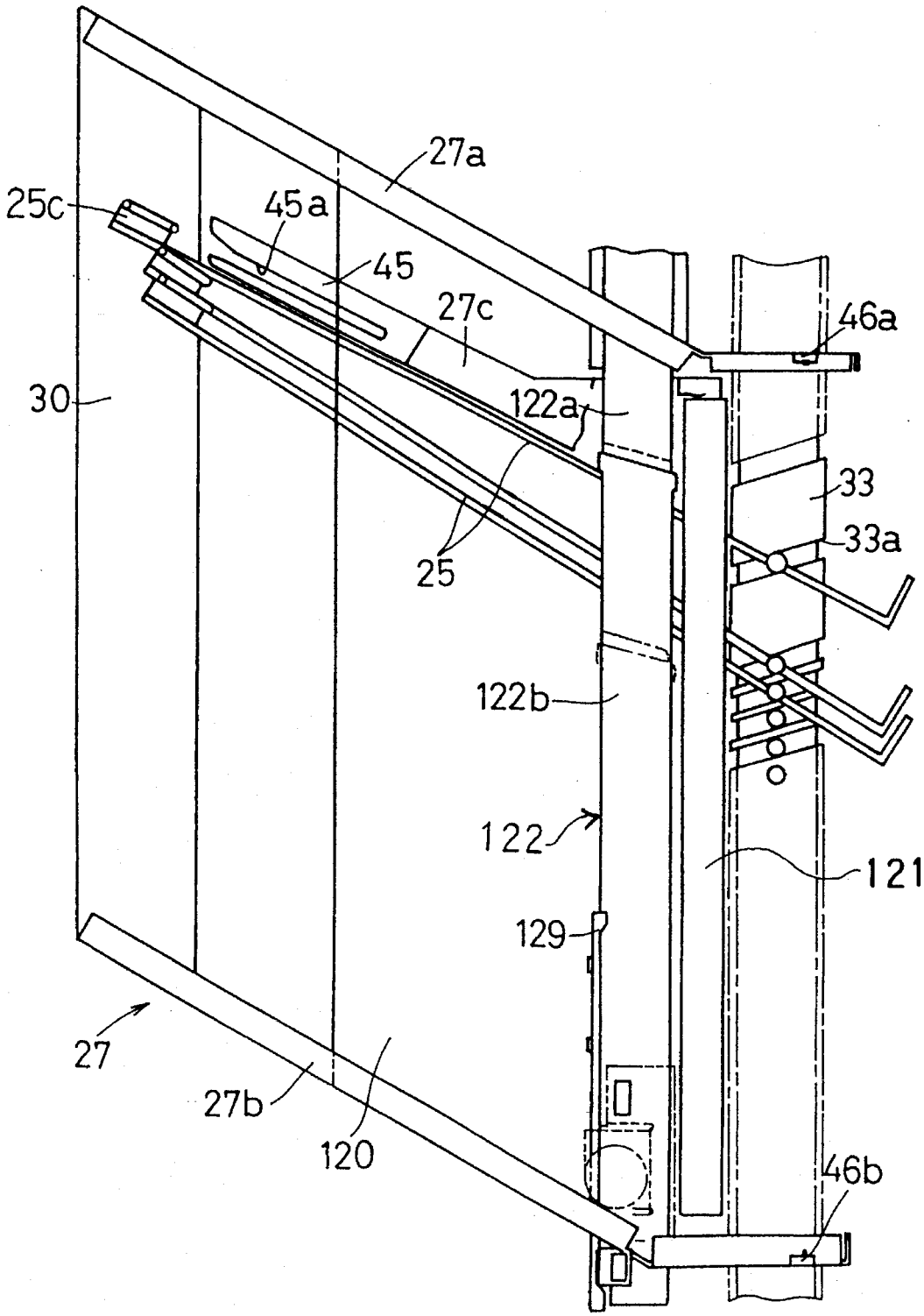
FIG. 7 is a partial vertical section view of the above sorter.

Referring to FIG. 7, an upper frame 27*a* and a lower frame 27*b* are provided at the upper and lower ends of the bin unit 27, and they share the same angle of inclination as the bins 25. A bin guide 27*c* is provided on the side of the bin 25 which directly opposes the processing unit 29. The bin guide 27*c* guides the bin 25 by the winged portion 25*c* when it is taken into the copying machine body 1 during the operation of the processing means 29, as will be described later. The ends of the upper and lower frames 27*a* and 27*b* are fixed to the supporting frame 30 and support pins are provided on the opposite ends of the upper and lower frames 27*a* and 27*b* toward the copying machine body 1 side. More specifically, the support pin of the lower frame 27*b* is engaged with the groove 33*a* of the cam 33 (referring to FIG. 6) and the support pin of the upper frame 27*a* is inserted into a trunnion guide groove 2*b* (referring to FIG. 3) of the frame to support the bin unit 27. A bottom end of the guide bin 27*c* is fixed to the end of the sorter frame 2*a*. The bin guide 27*c* extends in the sheet discharging direction along the inclination of the bin 25, and is attached to a guide member 45 in which a guide slot 45*a* is formed. In addition, a pair of photosensors 46*a* and 46*b*, for detecting whether there are sheets in the bins 25 or not, are provided at the ends of the upper and lower frames 27*a* and 27*b* on the sheet supply side.

Figure 8:
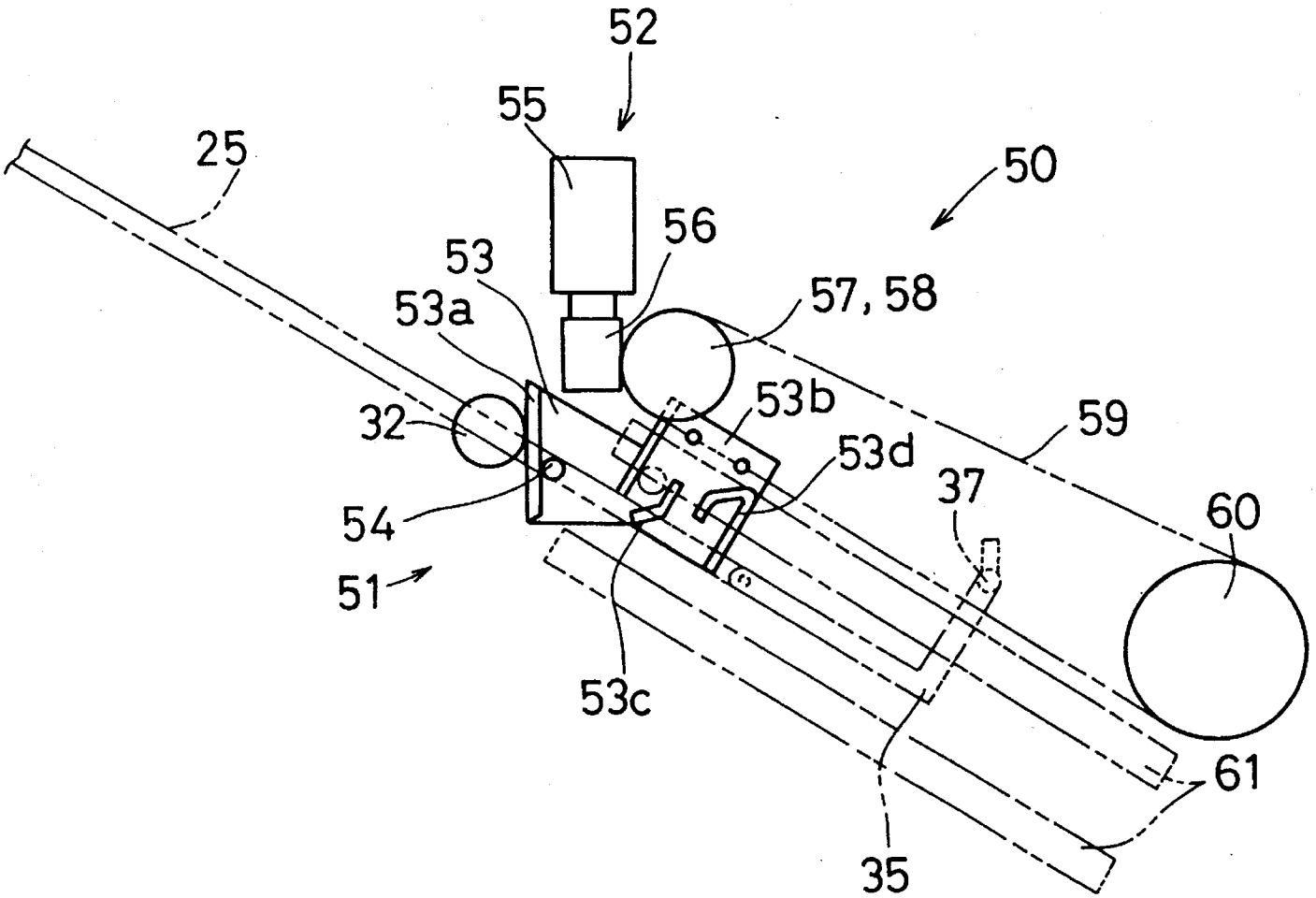
FIG. 8 is a schematic view showing a bin moving mechanism of the above sorter.

There is provided a bin sliding mechanism 50 for moving a bin 25 placed at the processing position to the processing unit 29 on the copying machine body 1 side and then returning it to the original position. The bin sliding mechanism 50 is shown in FIG. 8.

The bin sliding mechanism 50 is provided in the sorter frame 2*a* and includes a catch portion 51 to the bin 25 and a driving mechanism 52 for moving the bin 25 through the catch portion 51. The catch mechanism 51 includes a catch member 53. The catch member 53 (is provided behind the bin 25) and its catch is inserted between the trunnion 32 and the support pin 54 provided on the side of the trunnion 32. A catch portion 53*b* is provided on the catch member 53. The catch mechanism 51 is connected to the driving mechanism 52 by the catch portion 53*b*. The driving mechanism 52 includes a motor 55, a worm gear 56 fixed to the shaft of the motor 55, a worm wheel 57 engaged with the worm gear 56, a sprocket 58 integrally rotating with the worm wheel 57, and a sprocket 60 connected to the sprocket 58 through a chain 59. The chain 59 is connected to the catch portion 53*b* of the catch member 53. In this structure, by rotating the motor 55, the bin 25 can be moved in the sheet discharging direction along the guide member 61. The guide rail 61 is fixed to the sorter frame 2*a*.

According to the embodiment of the present invention, the processing unit 29 performs its operation while the bin 25 is in the processing unit 29. Since the guide bin 27*c* is provided in this embodiment, it is not necessary to provide the supporting frame as a guide member. Therefore, large openings can be formed on the front and rear sides of the bin 25.

Figure 9:
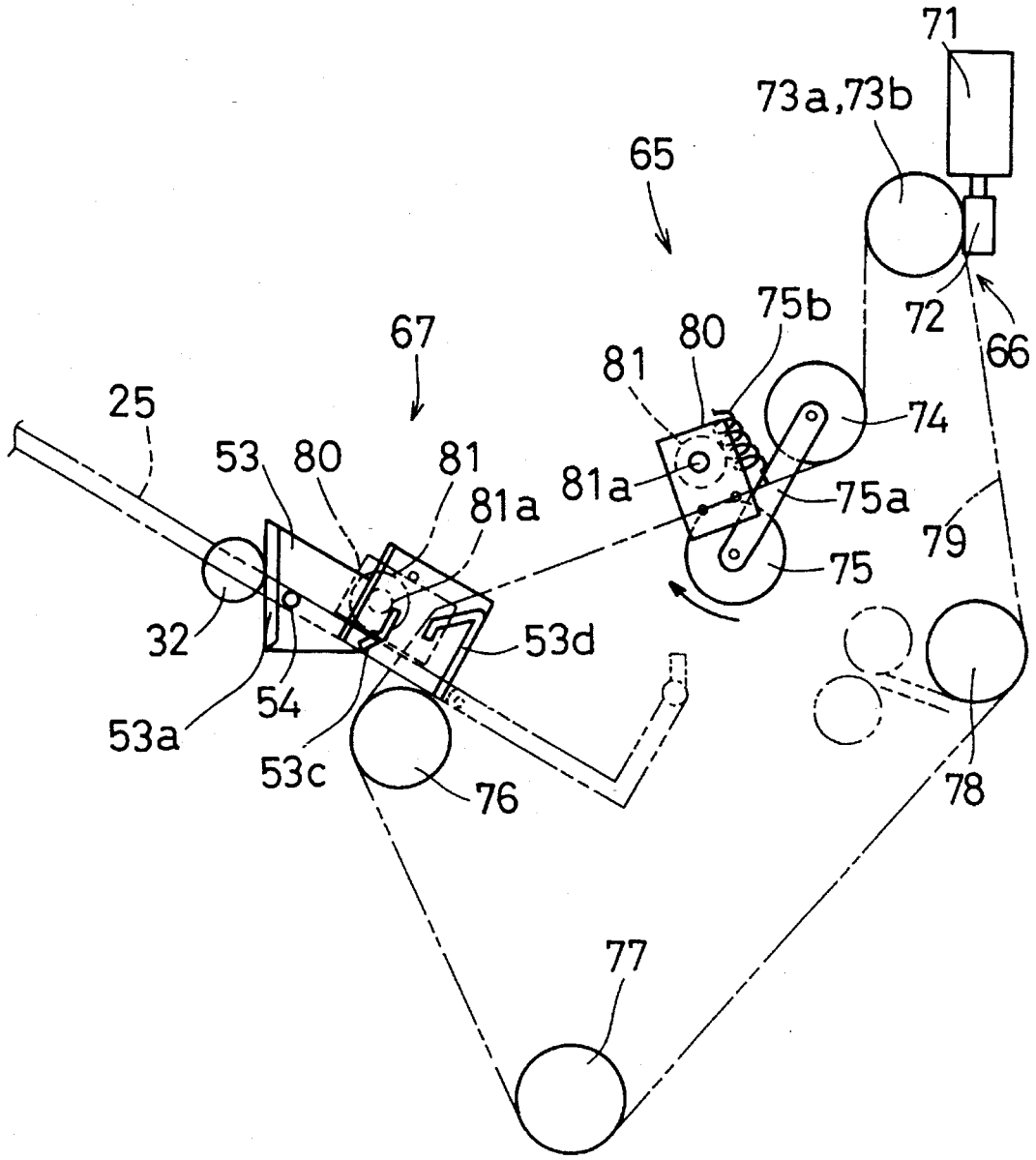
FIG. 9 is a schematic view showing a sheet pressing mechanism of the above sorter.

Referring to FIG. 9, the sorter 2 includes a sheet pressing mechanism 65 adapted to keep pressure on the sheets of the bin 25 which is slid back and forth into the processing unit 29. The sheet pressing mechanism 65 integrally moves with the bin 25 and it is mounted to the sorter frame 2*a* on both sides of the bin.

The sheet processing mechanism 65 includes a driving mechanism 66 and a pressing portion 67. The driving mechanism 66 includes a drive motor 71, a worm gear 72, a worm wheel 73*a* engaged with the worm gear 72, and sprockets 73*b*, 74, 75, 76, 77 and 78. A chain 79 extends around the sprockets 73*b* and 74 to 78. The chain 79 is disposed so as to pass between an engaged portion 53*c* and the guide portion 53*d* which are formed in the catch member 53 of the bin moving mechanism 50. In addition, between the sprockets 74 and 76, there is provided a pressing bar 81 riding on a shaft 81*a* and connected to chain 79 upon grips 80.

The sprocket 74 is connected to rotatably supported one end of an arm 75*a* and the sprocket 75 is rotatably connected to the other end of the arm 75*a*. Therefore, the sprocket 75 is rotatable about the sprocket 74, and it is impelled clockwise in FIG. 9 by a spring 75*b* connected to the arm 75*a*. The sprocket 77 is vertically movable and impelled downward, and maintains a predetermined tension on the chain 79, thereby maintaining engagement with each sprocket.

Thus, the catch member 80 is movable by the chain 79 between a position indicated by a solid line and a position indicated by a one-dotted line in FIG. 9. In the sheet pressing position indicated by the one-dotted line, the shaft 81*a* is engaged between the engaged portion 53*c* and the guide portion 53*d*. In a state where the shaft 81*a* is engaged with the catch member 53, it moves together with the bin 25. The pressing bar 81 is impelled toward the upper surface of the bin 25 by an impelling member (not shown).

Figure 10:
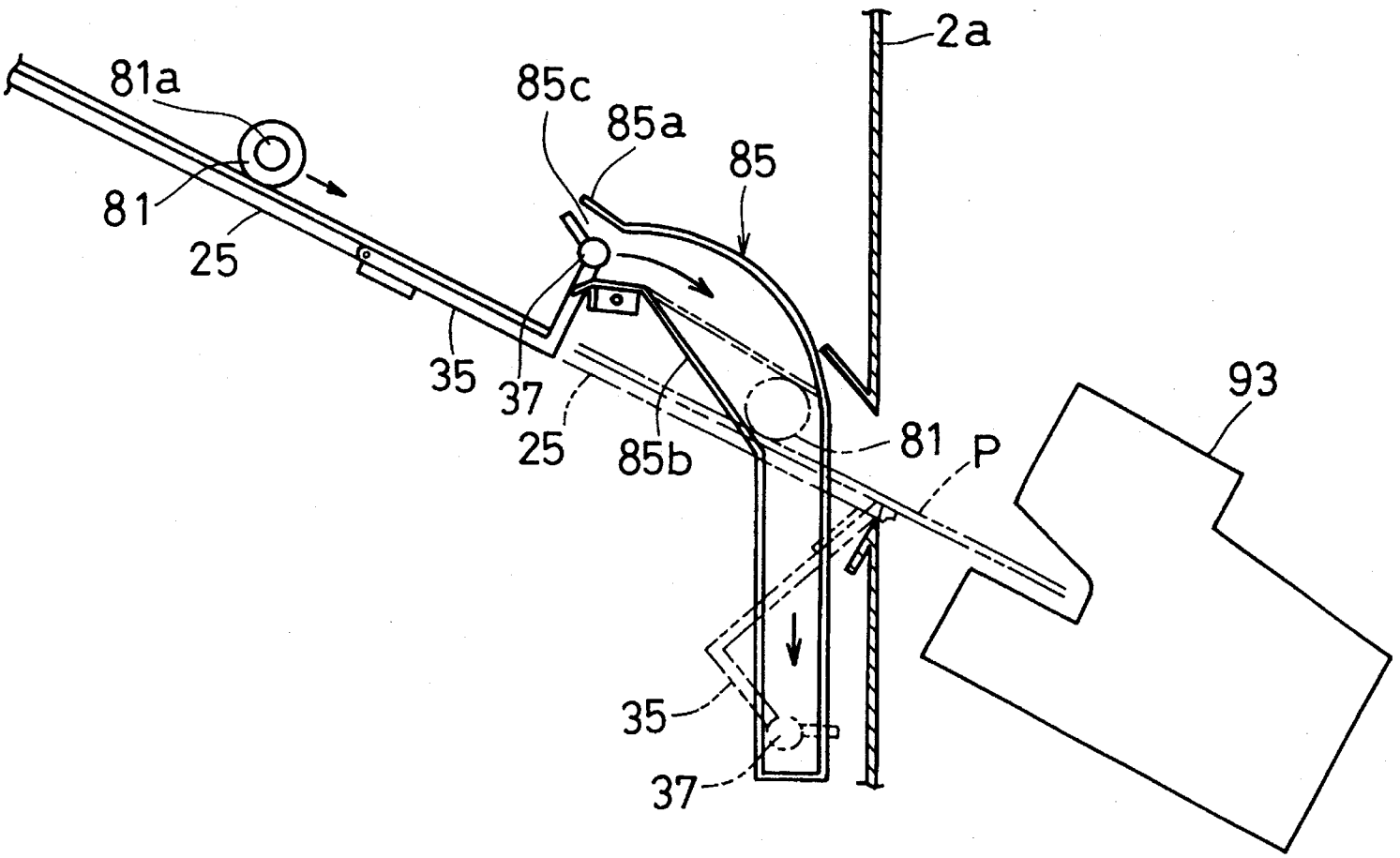
FIG. 10 is a partial section view of the above sorter.

Referring to FIG. 10, a guide member 85 for releasing the stop gate 35 of the bin 25 moved in the sheet processing position is provided in the sorter frame 2*a*. The guide member 85 guides the guide roller 37 of the stop gate 35 in the lower direction. The guide member 85 includes an upper rail 85*a* and a lower rail 85*b*, and an opening 85*c* formed at the end of the guide member 85.

Thus, while the guide roller 37 is guided downward by the guide member 85, the bin 25 is taken into the processing unit 29. The stop gate 35 is thereby made to pivot open in the lower direction exposing the trailing edges of the sheets. The sheets on the bin 25 can easily be processed, and as is shown in FIG. 10, since the sheets on the bin 25 are pressed by the sheet pressing bar 81, the sheets are kept from falling out of the bin 25 into the processing unit 29.

Figure 11:
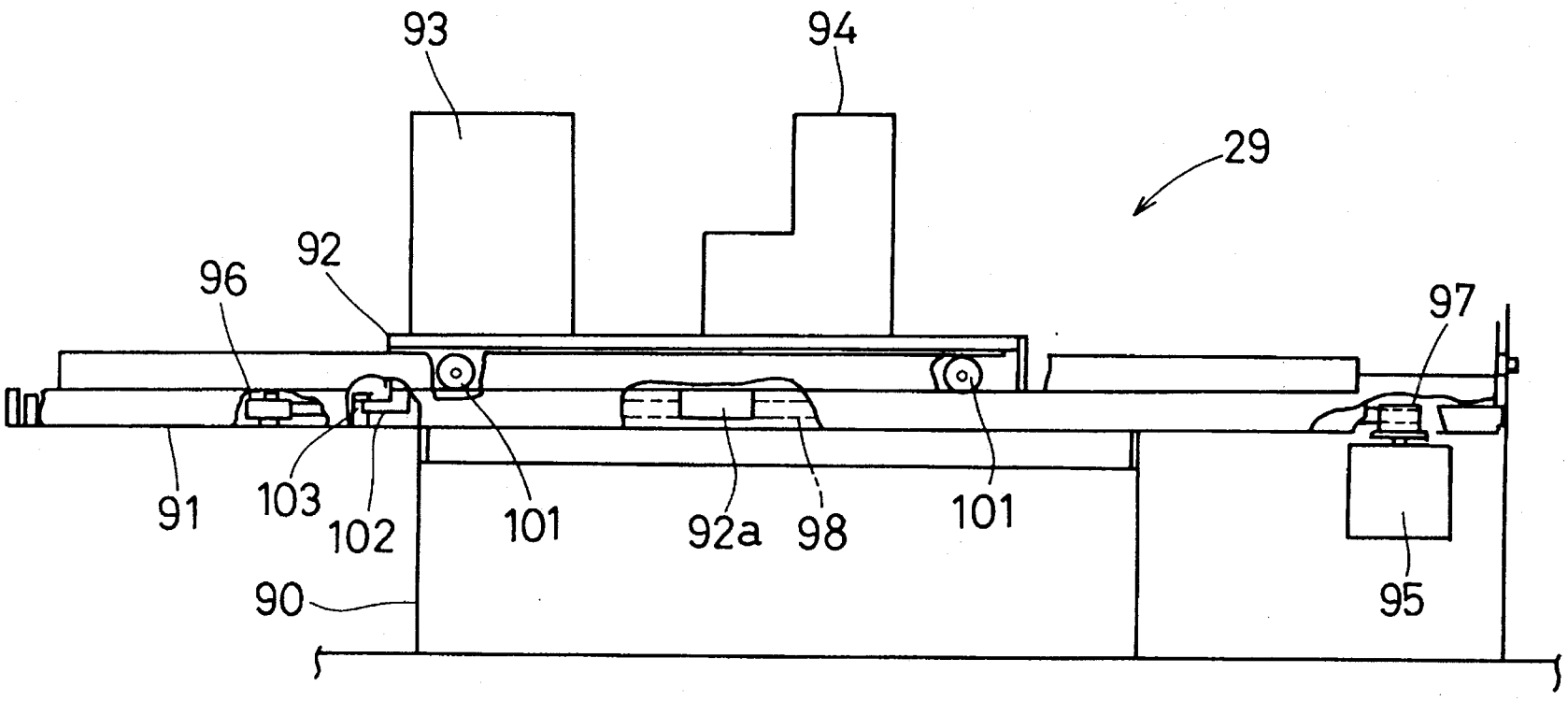
FIG. 11 is a side view showing a moving mechanism of a processing unit of the above sorter.
Figure 12:
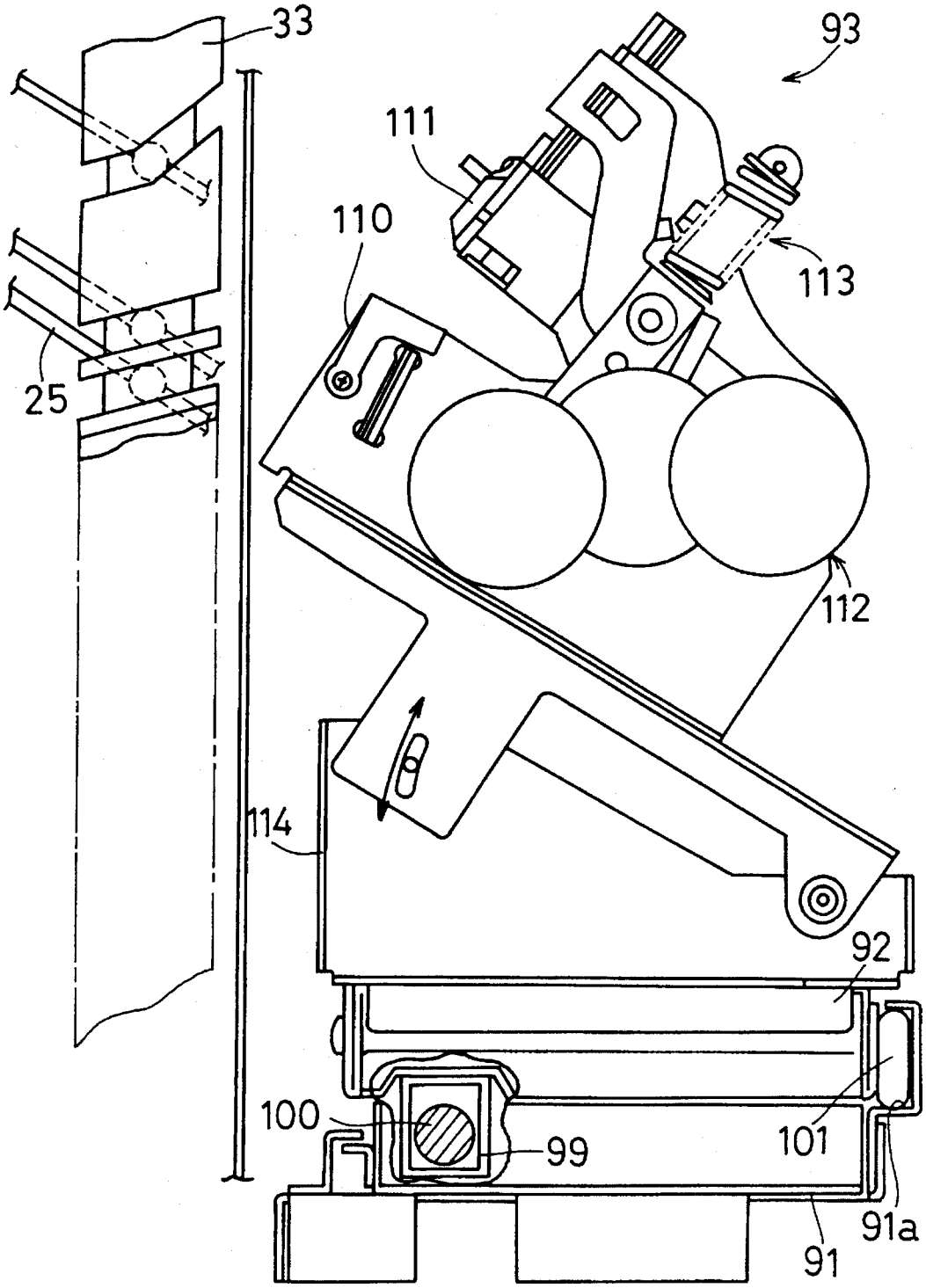
FIG. 12 is a front view of the processing unit of the above sorter.

Referring to FIGS. 11 and 12, the processing unit 29 includes a fixed frame 90, a base table 91 which is slidable on the fixed frame 90 and can be withdrawn to the front side of the machine, and a moving table 92 movable on the base table 91. A stapler 93 and a punching unit 94 are disposed on the moving table 92.

A motor 95 for moving the table is fixed to the lower surface of the base table 91 on the rear side of the machine. Meanwhile, a gear pulley 96 is fixed to the base table 91 on the front side of the machine. A timing belt 98 extends around the gear pulley 96 and the gear pulley 97 fixed to the end of the motor 95. A connecting portion 92*a* formed on the lower surface of the moving table 92 is connected to the timing belt 98, and the moving table 92 moves on the base table 91 by rotation of the timing belt 98. A bearing 99 is fixed to the lower surface of the moving table 92 as shown in FIG. 12, and it is movable along a guide rod 100 disposed on the base table 91 in the front-to-rear direction. In addition, a plurality of guide rollers 101 are provided on the side of the moving table 92 and guided by a supporting portion 91*a* of the base table 91.

As shown in FIG. 11, a detection plate 102 is fixed to the lower surface of the front end of the moving table 92 and a photosensor 103 for detecting a home position is fixed to a reference position of the base table 91.

FIG. 12 shows a schematic structure of the stapler 93.

The stapler 93 includes a lower jaw 110, an upper jaw 111 rotatably mounted to the lower jaw 110, a drive portion 112 for lowering the upper jaw 111, and a returning mechanism 113 for returning the upper jaw 111 to an initial position. The lower jaw 110 is rotatable within a predetermined range about one end of the supporting member 114 fixed to the moving table 92. Thus, the position of the stapler 93 can be adjusted in the vertical direction.

Figure 13:
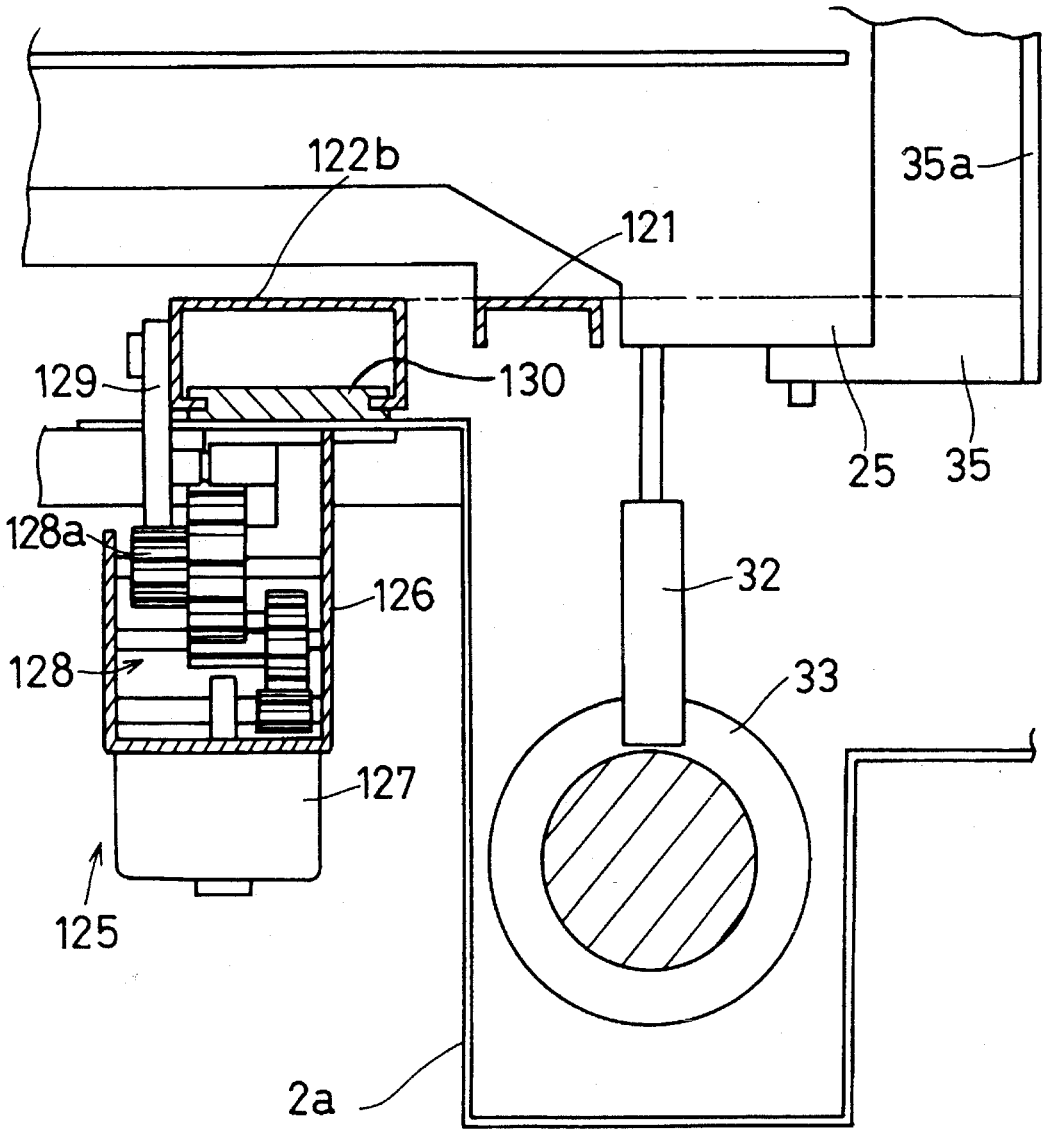
FIG. 13 is a plan view of a driving mechanism of a sheet reference member used in the above sorter.

The sorter 2 has openings 120 (referring to FIG. 7) on its front and rear sides between the supporting frame 30 and the sorter frame 2*a* (referring to FIG. 13). A fixed reference member 121 for lateral adjustment of the sheets and a lifting reference member 122 are provided at the end of the sorter frame 2*a* on the front side of the machine. The reference members 121 and 122 are disposed adjacent to the end of the cam 33 on the sheet discharging direction. The lifting reference member 122 includes a fixed upper reference member 122*a* and a vertically movable lower reference member 122*b* which serves as a shutter member. The lower reference plate 122*b* is movable between a closed position indicated by a solid line in FIG. 7 and an opened position indicated by a one-dotted line in the figure. The lower reference plate 122*b* opens exposing the side of the bin 25 disposed at a level for stack discharge, which is just under the bin 25 which is opposed to the processing unit 29. Distinguishing a bin for stack discharge separate from a bin for processing allows for parallel operation of the discharger and the processing unit.

Referring to FIG. 13, a lifting mechanism 125 for lifting the lower reference plate 122*b* is provided at the end of the sorter frame 2*a*. The lifting mechanism 125 includes a frame 126 provided at the end of the sorter frame 2*a*, a motor 127 fixed to the frame 126, and a gear train 128 rotatably supported in the frame 126. The gear train 128 is driven by the motor 127, and a pinion 128*a* of the gear train 128 is engaged with a rack 129 fixed to the lower reference plate 122*b*.

Thus, the lower reference plate 122 is lifted up and down together with the rack 129 by the motor 127. In addition, the lower reference plate 122*b* is lifted up and down, while guided by a slide guide 130 fixed to the sorter frame 2*a*.

According to the embodiment of the present invention, the cam 33 is disposed downstream from the standing wall 35*a* of the stop gate 35 in a sheet-discharging direction. Therefore, even if the reference members 121 and 122 are disposed in the vicinity of the cam 33, the reference members 121 and 122 can abut on a portion close to the center of the sheet in the longitudinal direction. Then, since the cam 33 can be disposed adjacent to the reference members 121 and 122, it is not necessary to extend the sorter frame 2*a* for covering them toward the ends of the sheets, and the sorter frame 2*a* can be miniaturized. In addition, the lifting reference member 122*b* is positioned at the end of the sorter frame 2*a*, and the lifting mechanism 125 for driving it is also disposed at the end of the sorter frame 2*a*. Therefore, the whole of the sorter 2 can be miniaturized.

As shown in FIG. 2, the transporting unit 28 of the sorter 2 includes an inlet portion 28*a*, a transporting route 28*b* for sorting, and a transporting route 28*c* for non-sorting, which diverge from the inlet portion 28*a*. A guide roller 131 and a fork 132 are provided at the inlet portion 28*a*. The transporting route 28*b* is provided between the inlet portion 28*a* and the bins 25 for sorting and it transports sheets onto the bin 25 whose upper space is widened by the cam 33. The transporting route 28*c*, for transporting sheets in the non-sorting mode to bin 133, is provided between the bin 133 and the inlet portion 28*a*.

Multistacker

Figure 14:
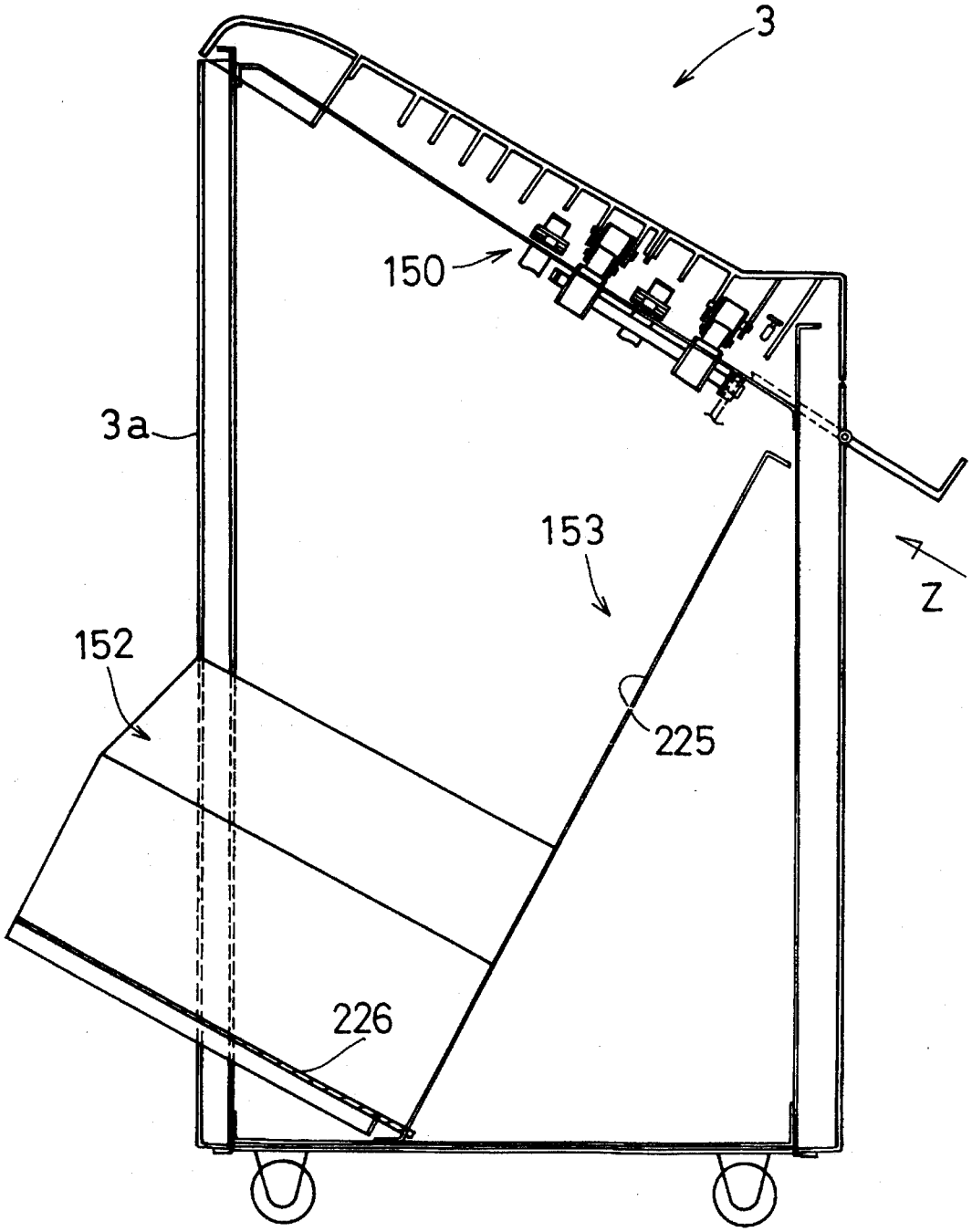
FIG. 14 is a schematic vertical sectional front view showing a multistacker of the above copying machine.
Figure 15:
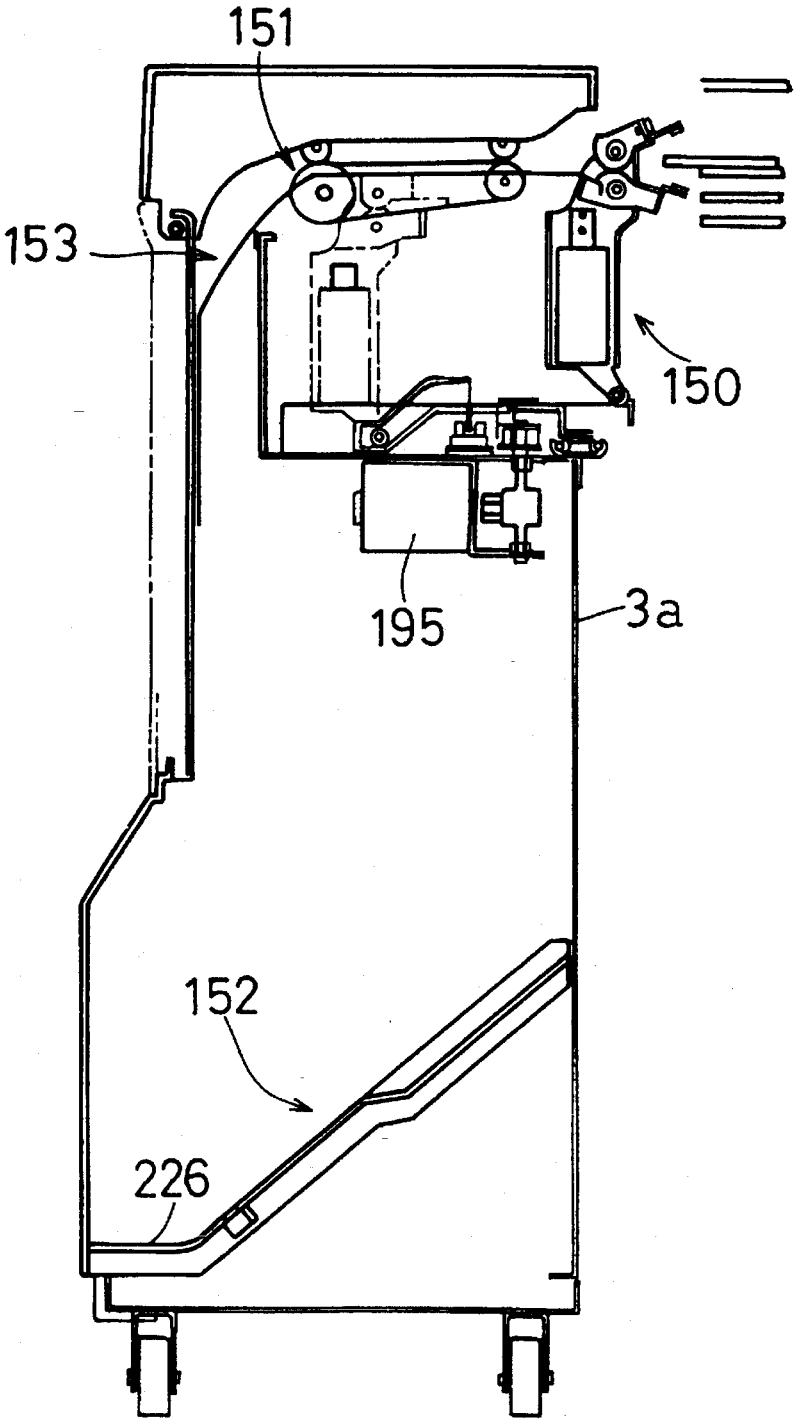
FIG. 15 is a sectional side view of the above multistacker.

FIGS. 14 and 15 show an overall structure of a multistacker 3. FIG. 14 is a front view of the multistacker 3 and FIG. 15 is a side view of the multistacker 3 viewed from the direction indicated by an arrow Z of FIG. 14.

The multistacker 3 includes a case or body 3*a* and consists of a stacker hand mechanism 150 which grasps a processed sheet stacks supported on the bin 25 placed at a position where it is to be taken out and withdraws the sheet stacks into the multistacker 3, a discharging mechanism 151 for discharging the sheet stacks withdrawn by the stacker hand mechanism 150, a stack portion in which the discharged sheets are housed, and a sheet stack transport path 153 guiding the sheet stacks removed from the bin 25 into the stack portion 152.

Figure 16:
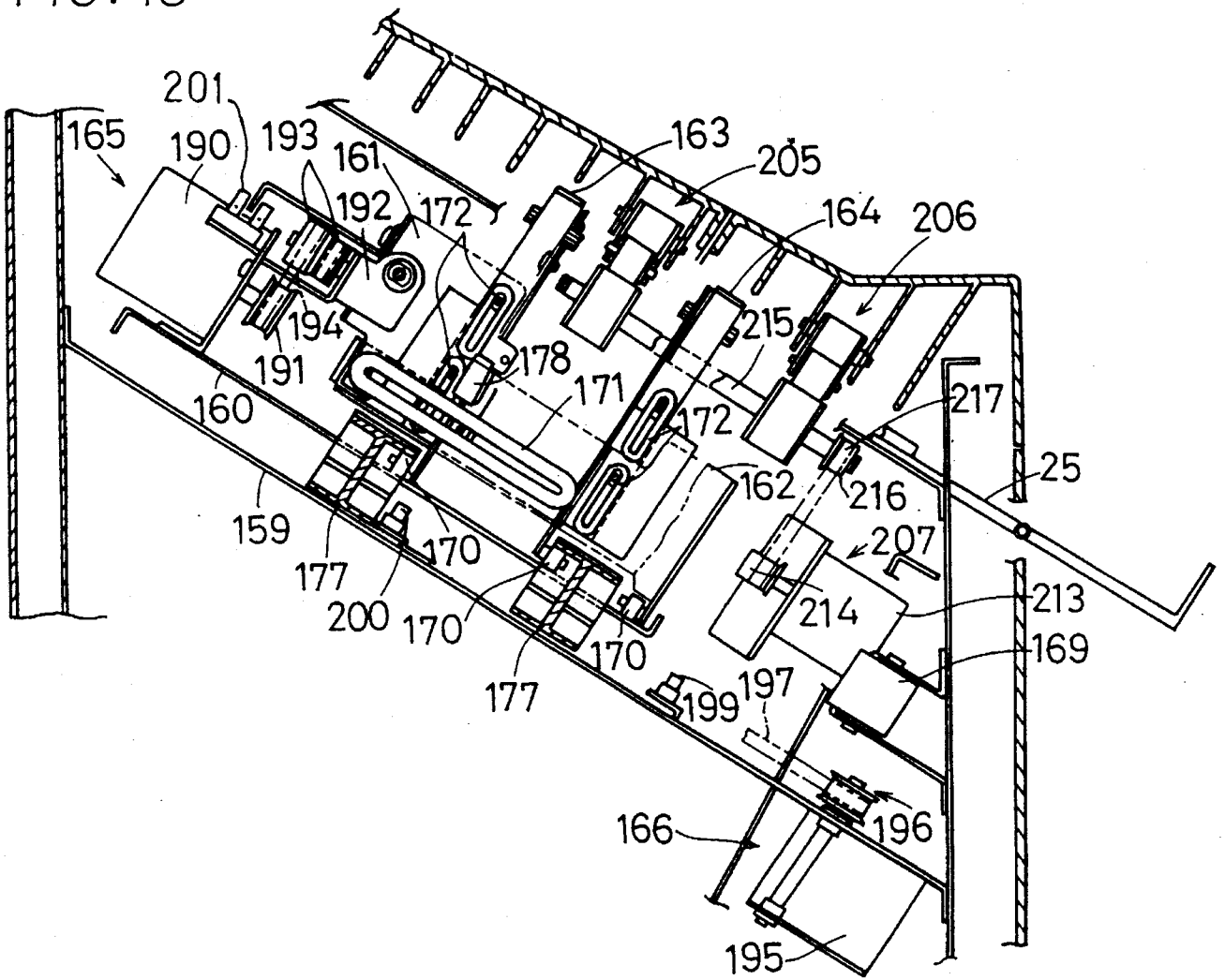
FIG. 16 is a partial sectional front view of the above multistacker.
Figure 17:
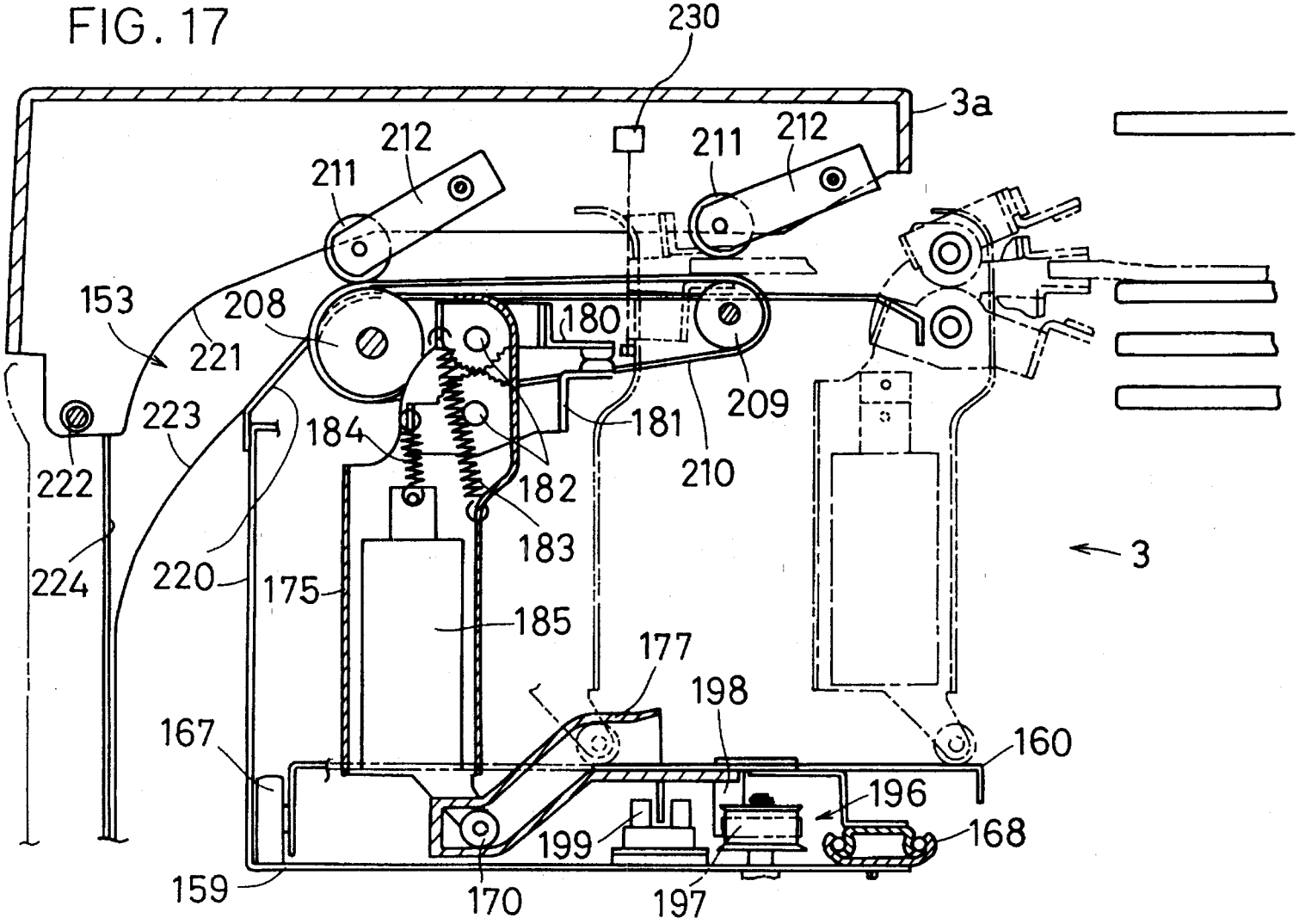
FIG. 17 is a partial sectional side view of the above multistacker.

Referring to FIGS. 16 and 17 which are enlarged views of FIGS. 14 and 15, the stacker hand mechanism 150 includes a base 159, a moving plate 160 moving the base 159 in the lateral direction, first and second hand mounting plates 161 and 162 provided on the moving plate 160 so as to be movable in the front-to-rear direction of the machine, first and second hands 163 and 164 mounted to the mounting plates 161 and 162, respectively, a first drive mechanism 165 moving the hands 163 and 164 in the front-to-rear direction, a second drive mechanism 166 moving the moving plate 160 in the lateral direction. The first hand mounting plate 161 is prevented from moving on the moving plate 160 in the lateral direction, while the second hand mounting plate 162 can move on the moving plate 160 in the lateral direction.

The base 159 is inclined at almost the same angle as the bins 25. A roller 167 is provided at the end of the moving plate 160 on the front side of the machine as shown in FIG. 17, and a guide 168 for sliding is disposed on the other end thereof in the lateral direction. The moving plate 160 is moved by the second drive mechanism 166 toward the copying machine body. In addition, a stopper roller 169, provided at the end of the sorter 2 on the copying machine body i side, abuts on the second hand mounting plate 162. A roller 170 is provided under each of the hands 163 and 164, and the second hand mounting plate 162, which moves on the moving plate 160 in the front-to-rear direction of the machine. A slide guide 171 having a guide groove in the lateral direction is fixed to the second hand mounting plate 162. The first hand mounting plate 161 includes a catching portion catching the slide guide 171.

Each of the hands 163 and 164 has a hand frame 175. The roller 170 is provided at the lower end of the hand frame 175. The hand frame 175 is vertically movable along the slide guide 172 which is vertically provided on each of the hand mounting plates 161 and 162. Additionally, a guide member 177 is provided on the moving plate 160. The guide member 177 guides the roller 170 of each of the retreated hands 163 and 164 downward, whereby the upper portions of the hands 163 and 164 can retreat into (under) the sheet transport path 153. A sensor 178 for detecting that the first hand 163 has moved away from the second hand 164 a predetermined distance is fixed to the second hand mounting plate 162.

Referring to FIG. 17, each of the hands 163 and 164 includes a pair of upper and lower holding portions 180 and 181. Each of the holding portions 180 and 181 is rotatably supported to the hand frame 175 by a support pin 182. Gears are formed on the under-side of the base of the upper holding portion 180 and on the top-side of the base of the lower holding portion 181, and the opposing gears mesh with each other. The rear end of the upper holding portion 180 is impelled by a spring 183 so as to be opened. One end of a spring 184 is caught by the rear end of the lower holding portion 180, and the other end thereof is caught by an end of a plunger of a solenoid 185 mounted to the hand frame 175. Thus, when the solenoid 185 is off, the upper holding portion 180 is opened upward by the spring 183 and the lower holding portion 181 is opened downward. Oppositely, when the solenoid 185 is turned on and the plunger retreats, the lower holding portion 181 is rotated by the spring 184 so as to be closed and the upper holding portion 180 is rotated so as to be closed against the impelling force of the spring 183.

The first drive mechanism 165 includes a motor 190, a gear pulley 191 fixed to an end of the motor 190, a plurality of gear pulleys 193 fixed to a connecting member 192 of the first mounting plate 161, and a timing belt 194 extending around each gear pulley. Thus, when the motor 190 rotates, the connecting member 192 is moved by the timing belt 194, and two hands 163 and 164 are moved in the front-to-rear direction upon the hand mounting plates 161 and 162.

The second drive mechanism 166 includes a motor 195 fixed to the lower surface of the base 159, a gear train 196 (referring to FIG. 17) comprising a plurality of gear pulleys, and a timing belt 197. The timing belt 197 is connected to a catching portion 198 fixed to the lower surface of the moving plate 160.

Photointerrupters 199 and 200 for detecting a position of the moving plate 160 are disposed on the base 159 at a predetermined interval. In addition, a photointerrupter 201 for detecting that each of the hands 163 and 164 is placed at its home position is provided on the moving plate 160.

The discharging mechanism 151 includes two pair of roller units 205 and 206, a roller drive mechanism 207 driving the roller units 205 and 206.

As shown in FIG. 17, the roller units 205 and 206 comprise a drive roller 208 and a follower roller 209 disposed along the sheet transport path 153. A belt 210 transporting the processed sheets extends between both rollers 208 and 209. A pressing roller 211 is disposed above the rollers 208 and 209. The pressing roller 211 is rotatably mounted to the end of the supporting member 212. The supporting member 212 is rotatably mounted to a cover **3*a* covering the upper portion of the multistacker 3**.

The roller drive mechanism 207 includes a motor 213, a gear pulley 214 mounted to the end of the motor 213, a rotation rod 215 connecting the drive rollers 208 of the roller units 205 and 206, a gear pulley 216 fixed to the end of the rotation rod 215, and a timing belt 217 extending between both pulleys 214 and 216.

The sheet stack transport path 153 includes a lower guide 220, and an upper guide 221 formed of ribs on the lower surface of the cover **3*a* and a standing wall 224. The cover 3*a* is openable by a pin 222 from the lower frame constituting the standing wall 224. In the sheet stack transport path 153 comprising the lower guide 220 and the upper guide 221, a resin film 223 of an elastic member is provided at a portion bent downward Just after the roller units 205 and 206. The upper end of the elastic member 223 is fixed to the lower guide 220, and guides sheet stack transported along the sheet stack transport path 153 so as to abut on the standing wall 224, whereby falling speed of the sheet stacks is decreased. In addition, as shown in FIG. 14, the side wall 225 of the sheet stack transport path 153 is inclined along the rear sides of the transported sheets (sides of the trailing edges of the sheets in the bin 25). More specifically, it is mounted so as to form almost right angles with the bin 25. A photointerrupter 230 for detecting a jam of a sheet is provided downstream from the follower roller 209**.

The stack portion 152 is provided at a lower portion of the case **3*a* and includes a bottom wall 226 which is almost perpendicular to the side wall 225 of the sheet transport path 153. The bottom wall 226 extends toward the rear side of the machine and it is inclined upward as shown in FIG. 15. The stack portion has an opening 227 on the side thereof as can be clearly seen in FIG. 1**.

In the multistacker 3, the stacker hand mechanism 150 is adapted to extend outward from its position below the sheet transport path to the bin 25 placed at the sheet discharging position, the level at which the stacked sheets are discharged. Therefore, dead space between the bin 25 and the stack portion 152 can be effectively used, and height can be low as compared with an apparatus where the stacker hand mechanism 150 is disposed above the sheet transport path 153.

Since the grasping hands 163 and 164 are laterally slidable, even when the trailing edges of the sheets in the bin 25 are positioned behind the cam 33 with respect to the discharging apparatus, the sheet stack can be smoothly discharged out the front side of the machine. Therefore, the lateral length of a sorter 2 can be shortened.

Since the opening 227 through which the stacked sheets are discharged is provided on the side of the stack portion 152, the discharged stacked sheets can be taken out of the stack portion 152 during the sheet-discharging operation. For example, when a large number of sheets are copied, operation at all parts of the image forming apparatus is halted when the stack portion 152 becomes full in conventional apparatus. However, in the present invention the stacked sheets can be easily discharged from the stack portion 152 during the operations according to this embodiment, thereby, a large number of sheets are continuously processed and the operation of the image forming apparatus need not be halted.

Control Unit

As shown in FIG. 1, an operation panel 250 for operating the copying machine body 1 is provided on the upper surface of the copying machine body 1 on the front side thereof. The operation panel 250 includes a key selecting a sorting or non-sorting mode, a key selecting a stapling or non-stapling mode, a key selecting a punching or non-punching mode, a key selecting a stapling position or punching position, decimal keys setting the number of copies, and other keys.

There is disposed an operation panel 251 on front upper side of the sorter 2, through which an operator directly inputs a command to the sorter 2. The operation panel 251 includes a multikey for performing stapling and punching operations and an operation for taking the stacked sheets from the bin in parallel, and other associated keys. By pressing the multikey, the stacked sheets in the bin can be compulsorily discharged to the stack portion 152.

Figure 18:
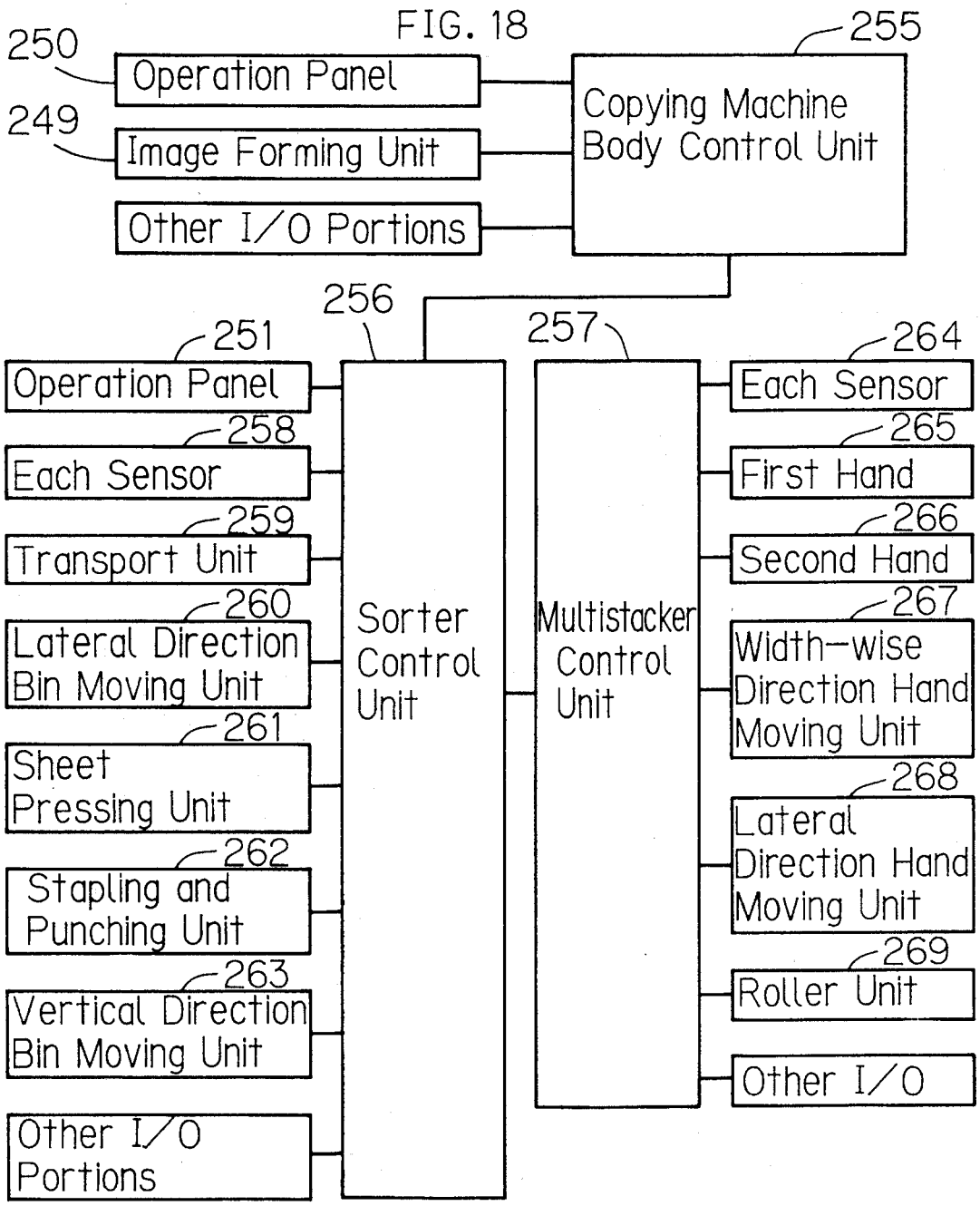
FIG. 18 is a control block diagram of the above copying machine.

FIG. 18 shows a schematic control block diagram of the copying machine.

The copying machine body 1 includes a copying machine body control unit 255 controlling a copying operation in the copying machine body 1 and an operation of an automatic original transport unit 11; the sorter 2 includes a sorter control unit 256; and the multistacker 3 includes a multistacker control unit 257. Each of the control units 255,256 and 257 includes a microcomputer comprising a CPU, a RAM, and a ROM. The control units 255,256 and 257 are connected through a bus, whereby several kinds of information can be interchanged among the control units.

To the copying machine body control unit 255 connected are the operation panel 250, an image forming unit 249 and other I/O portions. To the sorter control unit 256 connected are the operation panel 251, several kinds of sensors 258, the sheet transport unit 259, a bin moving unit 260 moving the bin in the lateral direction, a sheet pressing unit 261 for pressing the sheets in the bin 25, a stapling and punching unit 262, a bin moving unit 263 for moving the bin in the vertical direction, and other I/O portions. To the multistacker control unit 257 connected are several kinds of sensors 264, a first hand driving unit 265, a second hand driving unit 266, a hand moving unit 267 for moving the hands 163 and 164 in the front-to-rear direction, a hand moving unit 268 for moving the hands in the lateral direction, a driving unit 269 of the roller unit, and other I/O portions.

Operation of Copying Machine Body

Figure 19:
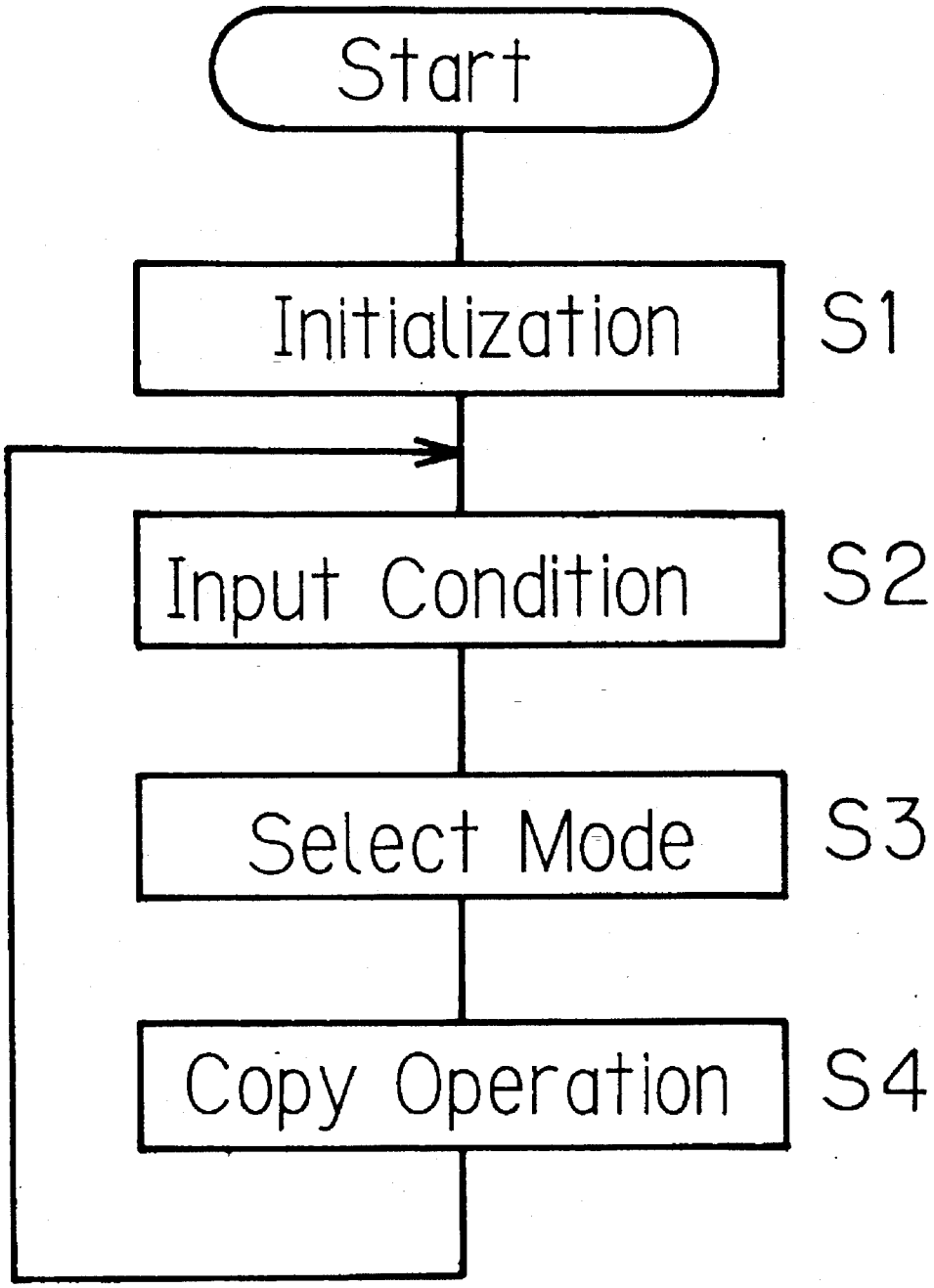
FIG. 19 is a control process flowchart of a copying machine body.

In the copying machine body 1, initialization procedure is carried out at step S1 in FIG. 19, wherein, for example, the number of copies is set to "1". In the initialization procedure, the non-sorting mode, the non-stapling mode and the non-punching mode are set.

Then, at step S2, a condition inputting operation such as receiving an input for setting the number of copies is performed. At step S3, a mode selecting operation to be described later is carried out. At step S4, a command for starting the copying operation through a print button is received. When the command for starting the copying operation is made, the copying operation is carried out by controlling the image forming unit and the automatic document transport unit 11. During the copying operation, a sheet is transported from a feeding cassette 19 or a feeding deck 20 to the image forming unit 6 and then, a toner image is transferred onto the sheet in the image forming unit 6. Then, the image on the sheet is fixed by the fixing unit 14 and introduced to the inlet 28 of the sorter 2 by the discharge rollers 15. The operation performed in the sorter 2 will be described later. After the copying operation is finished at step S4, the program returns to step S2.

Figure 20:
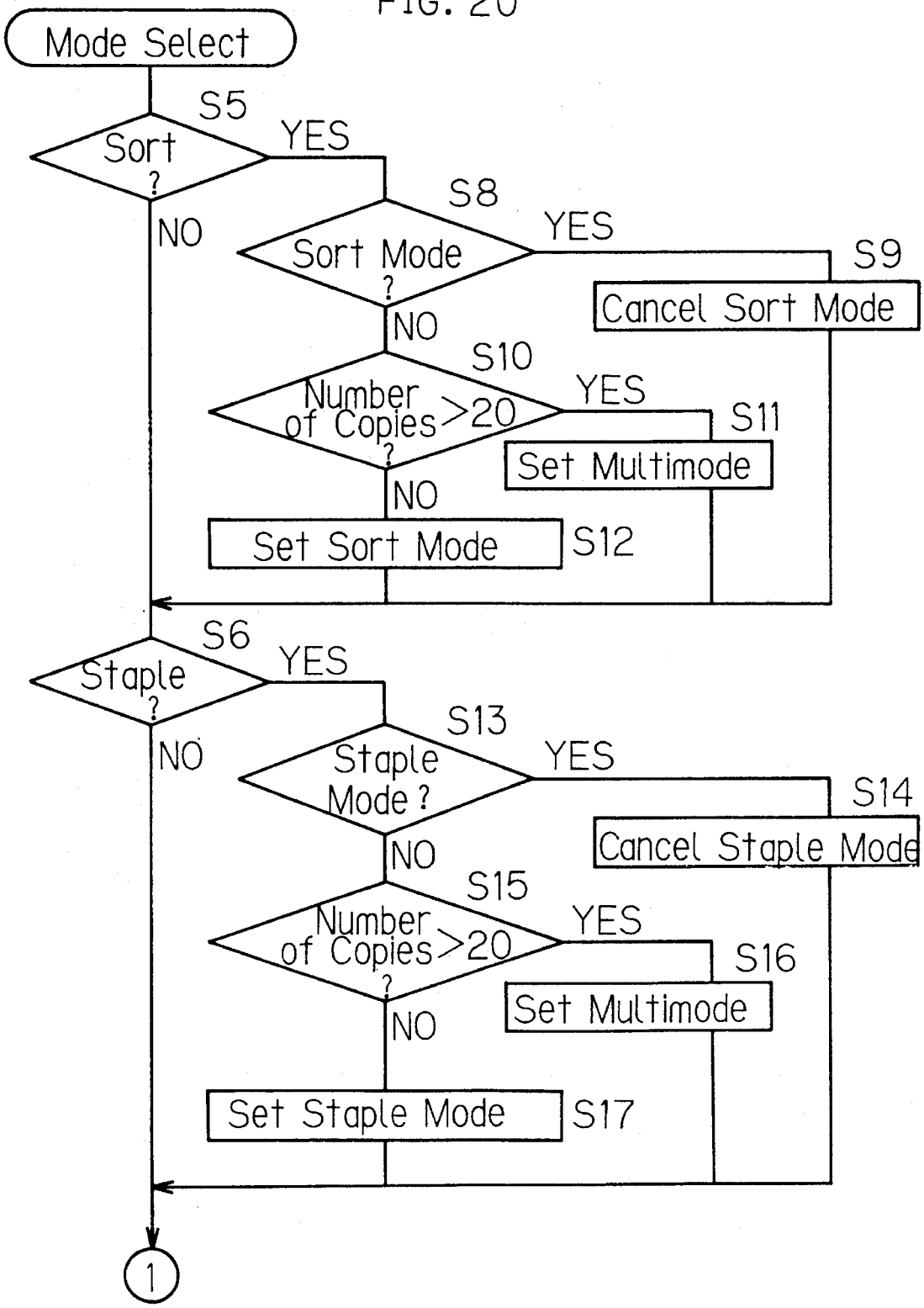
FIG. 20 is a flowchart of a mode selecting operation of the copying machine body.
Figure 21:
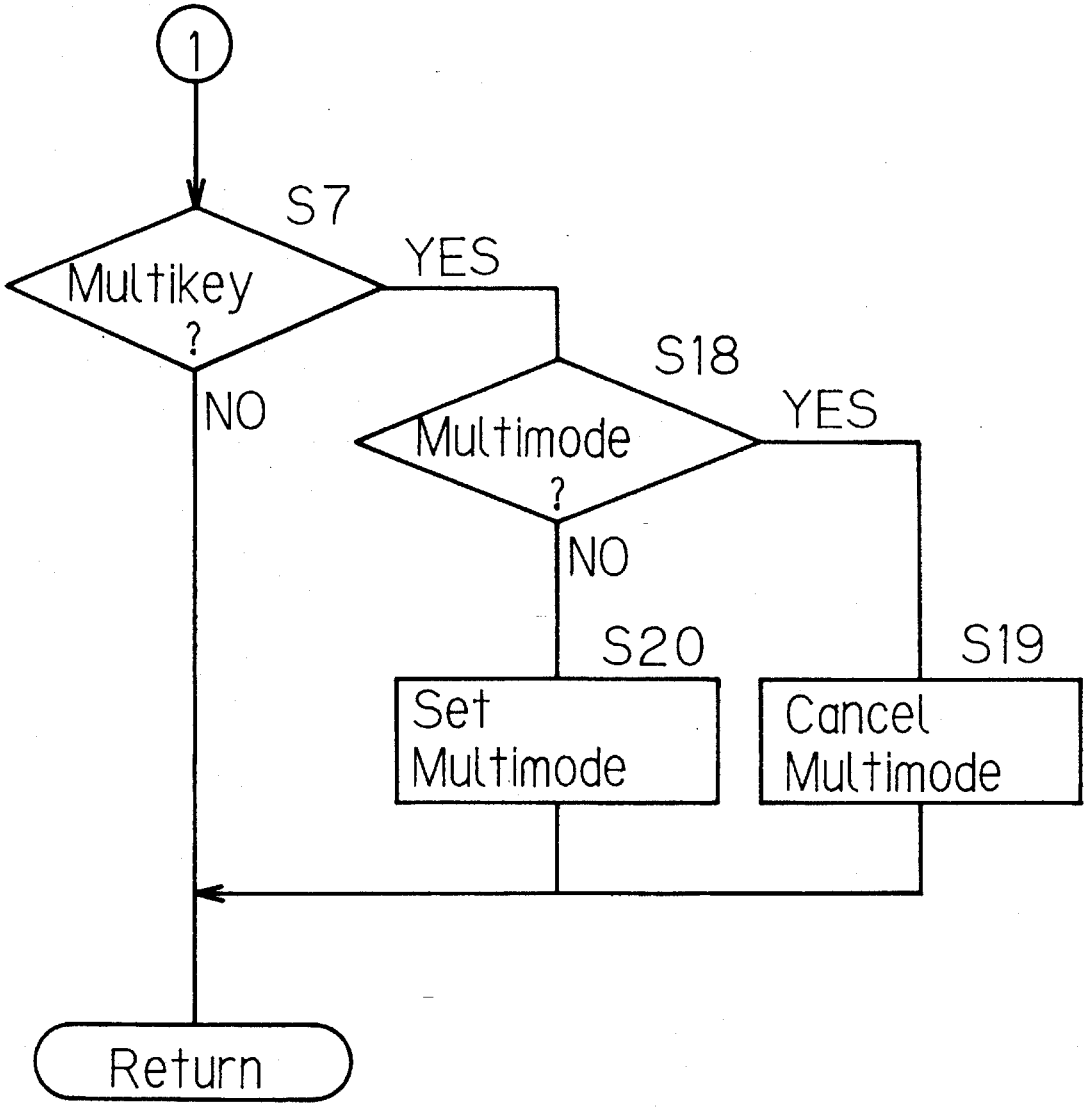
FIG. 21 is a flowchart of the mode selecting operation of the copying machine body.

The mode selecting operation at step S3 is shown in FIGS. 20 and 21.

Referring to FIG. 20, it is determined at step S5 whether the key for sorting operation has been pressed or not. It is determined at step S6 whether the key for the stapling operation has been pressed or not. It is determined at step S7 in FIG. 21 whether the multikey has been pressed or not.

When the sorting key is pressed, the program proceeds from step S5 to step S6. Wherein the sorting mode has been already set, the program proceeds to step S8, and the sorting mode is canceled. Meanwhile, wherein the sorting mode has not been set yet, the program proceeds from step S8 to step S10. It is determined at step S10 whether the set number of copies is more than the number of bins (20 in this example) or not. Wherein it is, the program proceeds to step S11, wherein the multimode is automatically set. Wherein the set number is 20 or less, the program proceeds from step S10 to step S12, wherein the sorting mode is set.

Wherein the stapling key has been pressed, the program proceeds from step S6 to step S13. It is determined at step S11 whether the stapling mode has been already set or not. Wherein it has been set, the program proceeds to step S14 and then, the stapling mode is canceled. Meanwhile, the stapling key is pressed while the stapling mode has not been set yet, the program proceeds from step S13 to step S15. It is determined at step S15 whether the set number of copies exceeds 20 or not. Wherein it exceeds, the program proceeds to step S16, wherein the multimode is set. Meanwhile, wherein the set number of copies is 20 or less, the program proceeds from step S15 to step S17, wherein the stapling mode is set.

Wherein the multikey has been pressed, the program proceeds from step S7 to step S18. It is determined at step S18 whether the multimode has been already set or not. Wherein it has been already set, the program proceeds to step S19. At step S19, the multimode is canceled. Meanwhile, wherein the multimode has not been set yet, the program proceeds from step S18 to step S20, wherein the multimode is set.

Operation of Sorter

Figure 22:
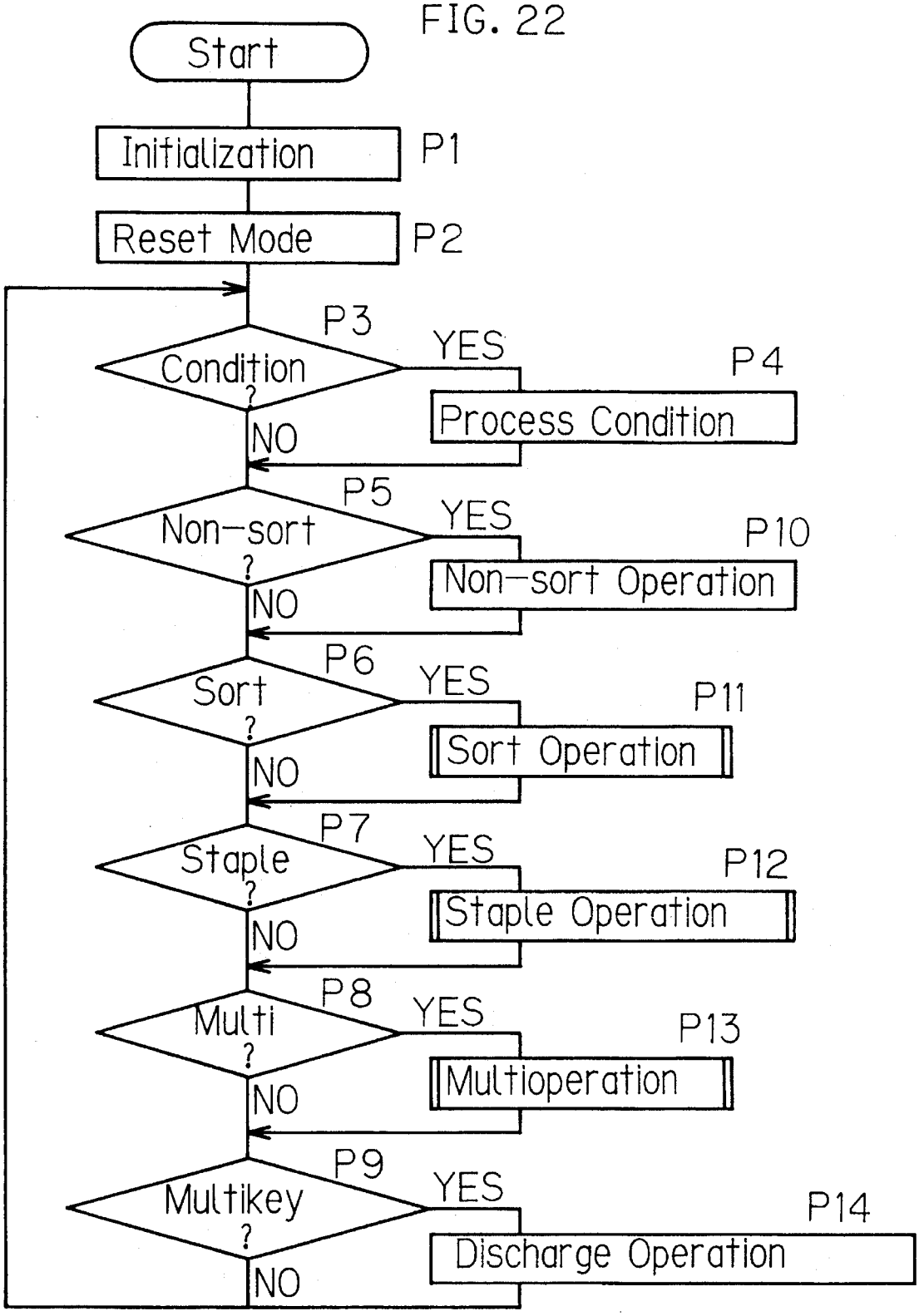
FIG. 22 is a control process flowchart of the above sorter.

Initialization procedure is carried out at step P1 in FIG. 22 in the sorter 2. In the initialization procedure, for example, each of the stapler and the punching unit is disposed at an initial position, or a claw fork 132 is set to the bin 133 for non-sorting.

At step P2, several kinds of modes are reset. As a result, the non-sorting mode, the non-stapling mode and the non-punching modes are set.

Then, at step P3, it is determined whether information of the processing condition such as the number of sheets to be processed or contents of the set mode is sent from the copying machine body 1 or not. Wherein there is an input of the processing condition, the program proceeds to step P4, wherein the operation modes corresponding to the condition are set.

It is determined at step P5 whether the operation mode is the non-sorting mode or not, at step P6 whether it is the sorting mode or not, at step P7 whether it is the stapling mode or not, at step P8 whether it is the multimode or not, and step P9 whether the multikey on the operation panel of the sorter 2 has been pressed or not.

Wherein the operation mode is the non-sorting mode, the program proceeds from step P5 to step P10, wherein the non-sorting operation is carried out. Meanwhile, the sorting mode has been set, the program proceeds from step P6 to step P11, wherein the sorting operation is carried out. Wherein the stapling mode has been set, the program proceeds from step P7 to step P12, wherein the stapling operation is carried out. Meanwhile, wherein the multimode has been set, the program proceeds from step P8 to step P13, wherein the multioperation is carried out. Wherein the multikey has been pressed, the program proceeds from step P9 to step P14, wherein the stacked sheets in the bin 25 are compulsorily discharged.

Figure 23:
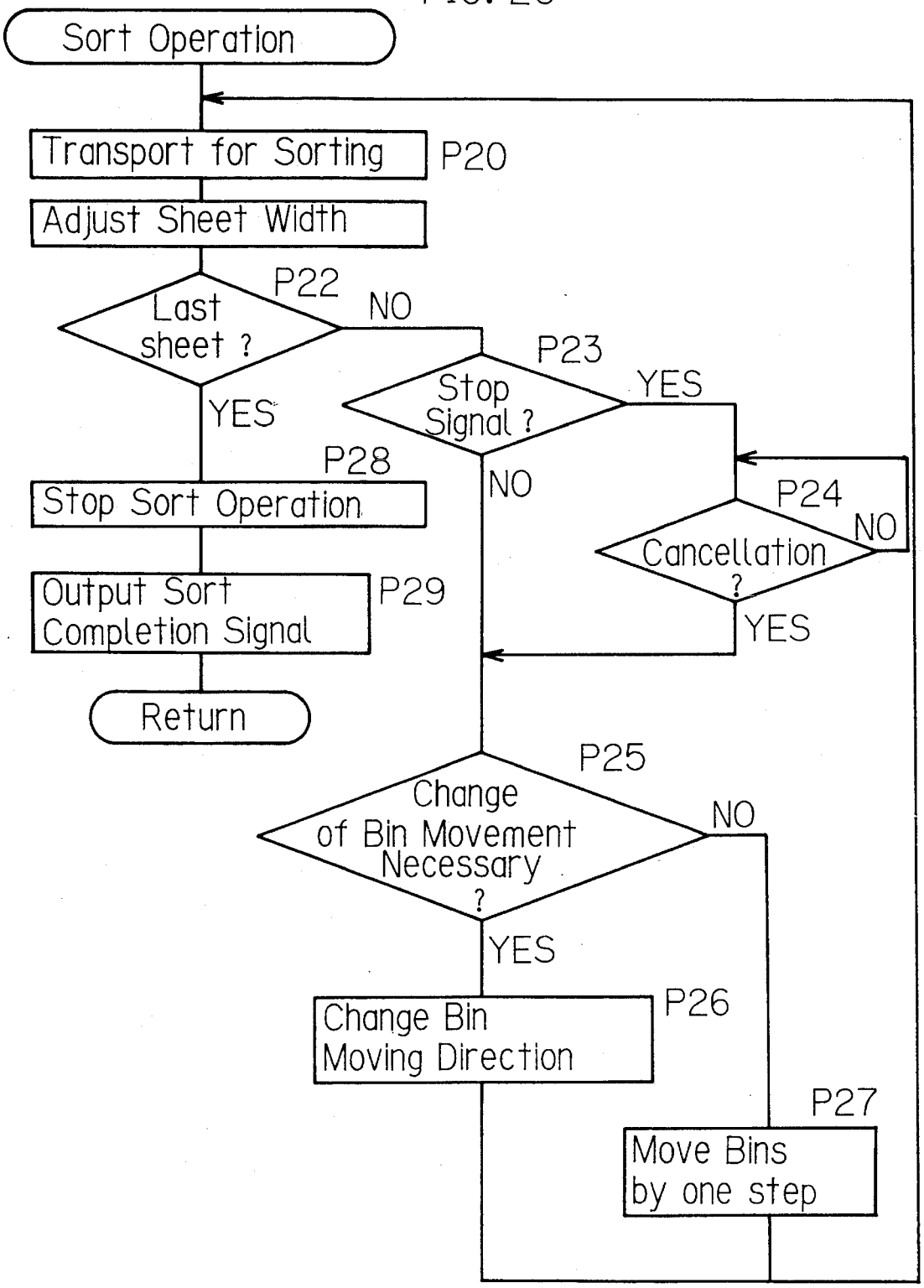
FIG. 23 is a flowchart of a sorting operation of the above sorter.

Sorting Operation

Wherein the sorting mode has been selected, the sorting operation shown in FIG. 23 is carried out.

In this case, first, the transporting operation for sorting is performed at step P20. More specifically, the fork 132 is switched so as to guide sheets from the copying machine body 1 to the transport path 28*b* for the sorting operation. Then, the sheets are discharged to the bins 25 each of which is successively moved in the vertical direction by the motor 43.

Then, at step P21, a width adjusting operation is performed by moving the lateral guide member 31 toward the front side, whereby the sides of the stacked sheets put in the bin 25 abut on the reference members 121 and 122 on the front side of the machine. Then, it is determined at step P22 whether the sheet introduced into the sorter 2 is the last one or not. Wherein it is not the last sheet, the program proceeds to step P23. It is determined at step P23, whether a stop signal, to be described later is output from the multistacker control unit 257 or not. Wherein it is, the program proceeds to step P24, wherein there is a pause until the stop signal is canceled. The stop signal is triggered when the stack portion 152 of the discharging apparatus 3 has become full, and a stop cancellation signal is output when the sheet stacks are emptied from the stack portion 152. When the cancellation signal is output, the program proceeds from step P24 to step P25. In the case when the stop signal is not output, the program proceeds from step P23 to step P25.

It is determined at step P25 whether it is necessary to change the moving direction of the bins or not. Wherein all bins are positioned above or under a position from which sheets are introduced, it is necessary to change the moving direction. In this case, the program proceeds from step P25 to step P26, wherein the moving direction of the bin unit 27 is changed. Wherein it is not necessary to change the moving direction, the program proceeds from step P25 to step P27, wherein the each bin 25 is moved in the same direction by one step. After the operations at steps P26 and 27 are finished, the program returns to step P20, wherein the above-described operations are repeated. Thus, when the all sheets are sorted into each bin 25, the program proceeds to steps P22 to step P28. At step P28, the driving operation at the inlet portion 28*a* of the sorter 2 is halted. Then, the program proceeds to step P29, wherein a sorting completion signal is output to the copying machine body control unit 255 and the multistacker control unit 257.

Figure 24:
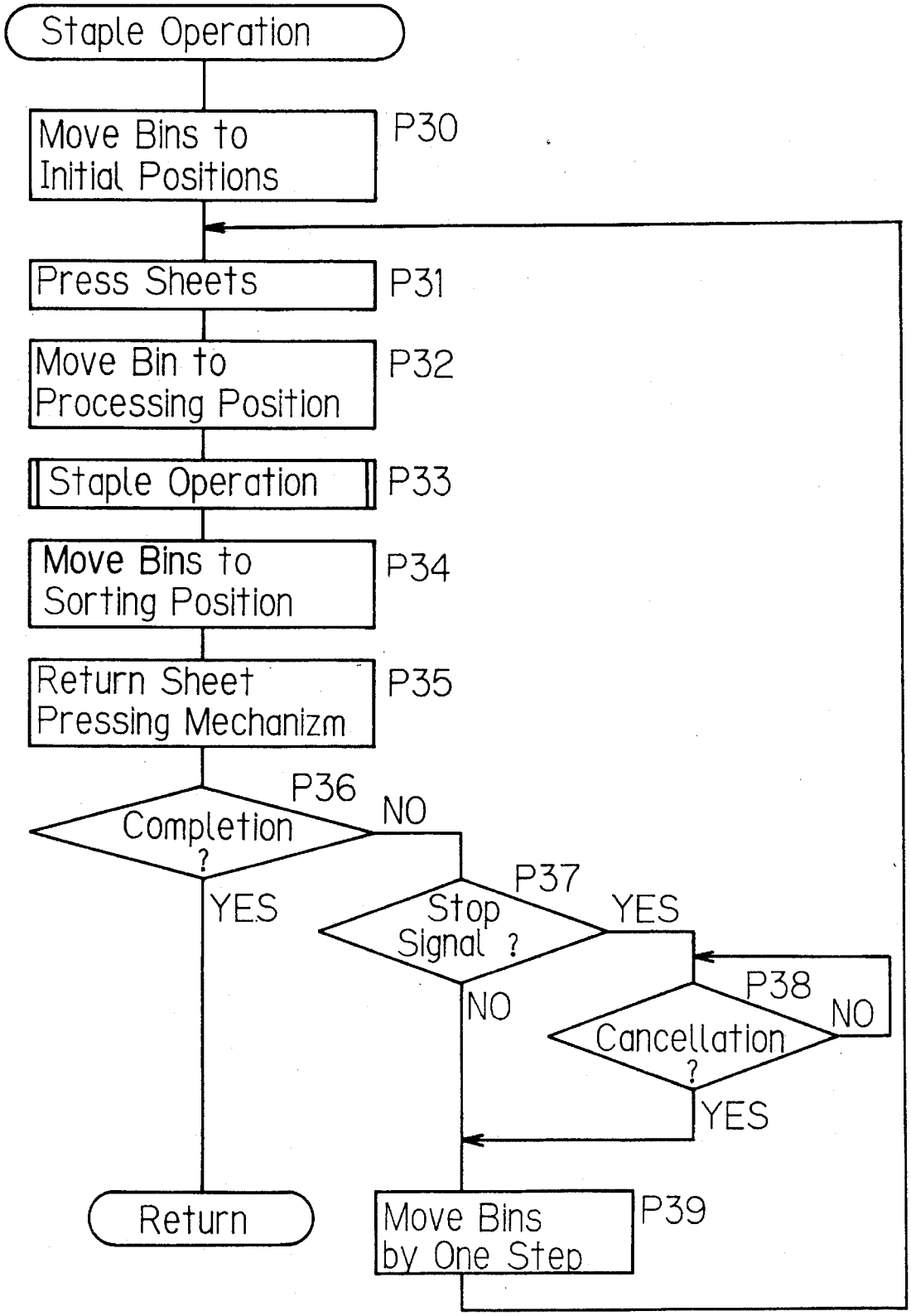
FIG. 24 is a control process flowchart of a stapling operation of the above sorter.

Stapling (Punching) Operation

Wherein the stapling mode has been selected, the operation shown in FIG. 24 is carried out. Since the stapling operation and the punching operation use the same control, a description will be given only to the stapling operation.

First, at step P30, all bins 25 are moved to their initial positions for the stapling operation. Then, at step P31, the sorted stacked sheets in the bin 25 are pressed by the sheet pressing mechanism 65. More specifically, at this time, the rotor 71 rotates, whereby the worm wheel 73*a* rotates and the timing belt 79 circulates. Thus, the connecting member 80 disposed at a position indicated by a solid line in FIG. 9 is moved toward the bin 25. Then, the shaft 81*a* supported to the connecting member 80 abuts on the connecting member 53, whereby the stacked sheets in the bin 25 are pressed from above.

At step P32, the bin 25 positioned opposed to the processing unit 29 is withdrawn into a processing position in the processing unit 29. More specifically, the drive motor 55 rotates to circulate the timing belt 29, whereby the connecting member 53 is moved toward the processing unit 29 through the catch portion 53*b*. Thus, the bin 25 abutting on the connecting member 53 is withdrawn into the processing unit 29. At this time, the guide roller 37 provided above the stop gate 35 of the bin 25 is guided downward by the guide member 85, whereby the stop gate 35 of the bin 25 is rotated downward as shown by a one-dotted line in FIG. 10 and then, the trailing edges of the stacked sheets are exposed as they are placed at the stapling position by the stapler 93.

Then, at step P33, the stapling operation to be described later is carried out. At step P34, the bin 25 is returned to the sorting position, and at step P35, the sheet pressing mechanism 65 retracts from the stacked sheets, whereby the previous operations are completely reversed. Then, it is determined at step P36 whether the stapling operation is to be performed on all the sorted stacks of sheets or not. Wherein it is not, the program proceeds to step P37. It is determined at step P37 whether the output signal is output from the multistacker control unit 257 or not. Wherein it is output, the program proceeds to step P38. At step P38, there is a pause until the stop signal is canceled. Wherein the stop signal is not output and the stop signal is canceled, the program proceeds to step P39. At step P39, each bin is moved by one step and then, the program returns to step P31. After the stapling operation is performed onto all of the sorted stacked sheets, the determination at step P35 becomes YES and then, the subroutine for the stapling operation is finished.

Figure 25:
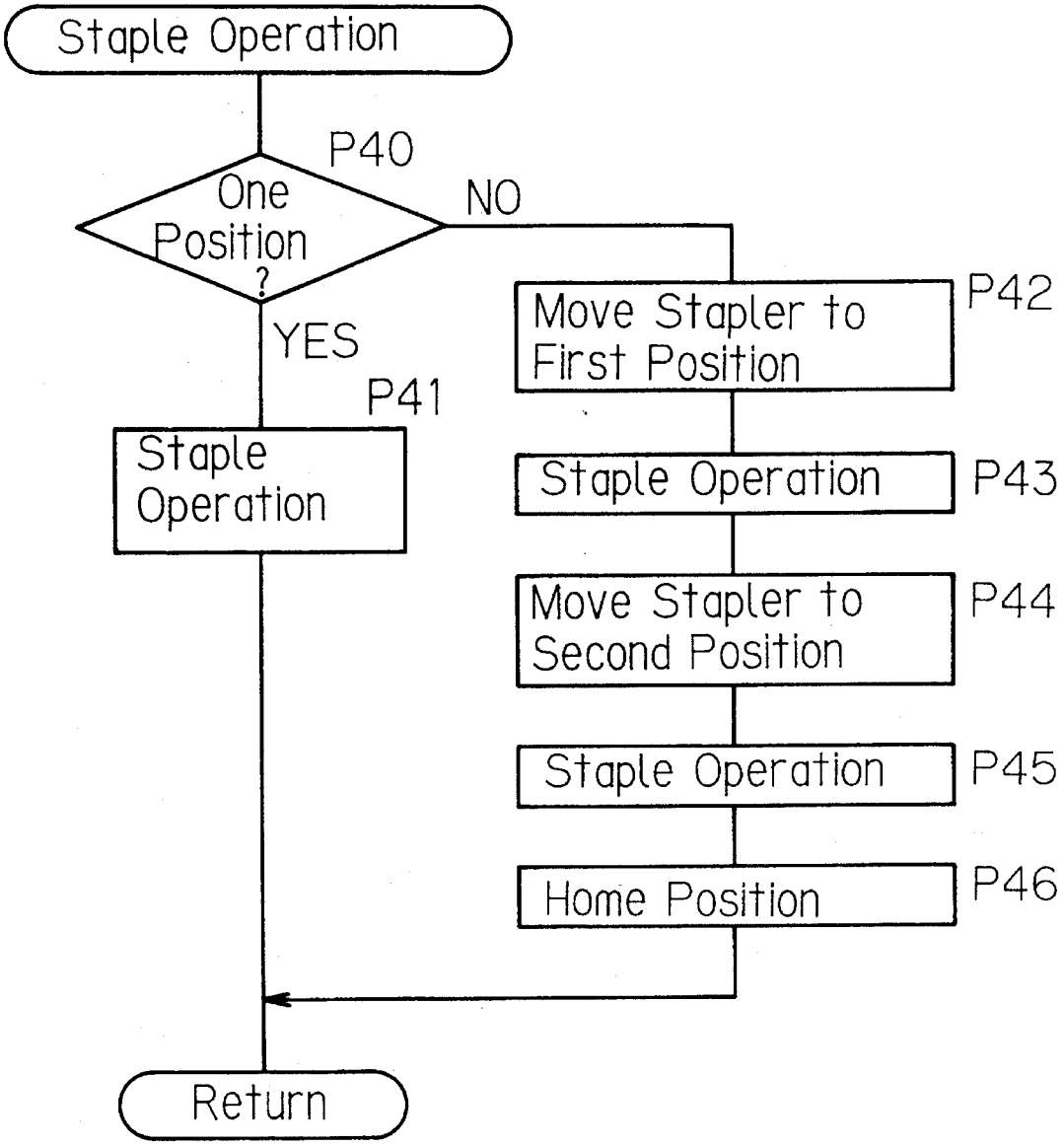
FIG. 25 is a specific control process flowchart of the stapling operation.

A specific control of the stapling operation at step P33 is shown in FIG. 25.

First, it is determined at step P40 whether the stapling operation is performed at one position or not. Wherein one stapling position is specified, the program proceeds to step P41, wherein the stapling operation is performed while the stapler 58 is fixed to its home position, that is, a reference position. Meanwhile, wherein the stapling operation is performed at two positions, the determination at step P40 becomes NO and then, the program proceeds to step P42. At step P42, The stapler is moved to a first position. Then, at step P43, the stapling operation is carried out at the first position. Then, at step P44, the stapler is moved to a second position and at step P45, the stapling operation is carried out at the second position. After the stapling operations are performed at two positions, the stapler returns to its home position at step P46 and then, the program proceeds to step P34 shown in FIG. 24.

Figure 26:
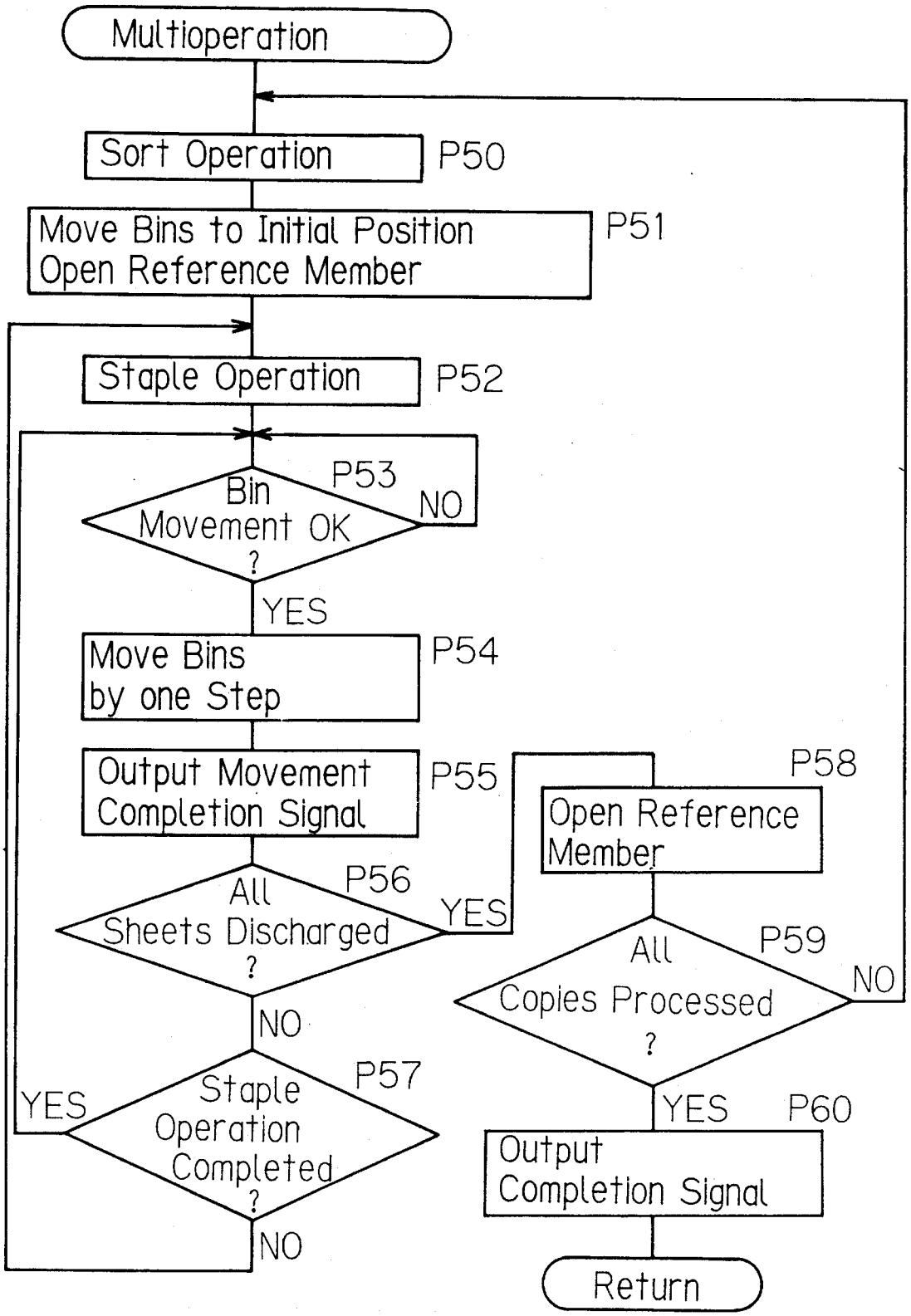
FIG. 26 is a control process flowchart of a multioperation of the above sorter.

Multioperation

Wherein the multioperation is set, the multioperation shown in FIG. 26 is carried out.

According to the multioperation, the sorting operation is carried out at step P50. The sorting operation is the same as those at steps P20 to P29.

After the sorting operation is finished, the program proceeds to step P51, wherein all bins 25 are moved to the initial position for the stapling operation. In addition, the lifting reference member 122 is lowered. Then, at step P52, the stapling operation is carried out. The stapling operation is the same as the operations at steps P31 to 39 and steps P40 to 46 shown in FIGS. 24 and 25.

Then, it is determined at step P53 whether the bins should be moved (lowered) or not. Referring to the first bin 25, the determination should be YES, but referring to on and after the second bin 25, the determination is made by a fact whether the stacked sheets are discharged from the bin 25 or not. Then, at step P54, each bin 25 is lowered by one step. Then, at step P55, a movement completion signal is output to the multistacker control unit 257, whereby the stacked sheets are discharged from the bin 25 into the multistacker 3.

It is determined at step P56, whether the stapled sheets are all discharged from the bins 25 or not. Wherein there is any stacked sheets in the bins 25, the program proceeds to step P57. It is determined at step P57 whether the stapling operation onto the all stacked sheets in the bins 25 is completed or not. Wherein it is not completed, the program returns to step P52, and operations at steps P52 to 56 are repeated. Wherein the stapling operation onto all of the stacked sheets is completed, the program proceeds to step P53, and operations at steps P53 to P55, that is, an operation lowering the last bin by one step is carried out.

Thus, all of the stacked sheets housed in the sorter are taken out to the multistacker 3 and then, the program proceeds from step P56 to step P58, wherein the lifting reference member 122 is lifted.

Then, it is determined at step P59 whether the sorting operation, the stapling operation and the discharging operation for the set number of copies are completed or not. Wherein they are not completed, the program returns from step P59 to step P50. More specifically, wherein the set number of copies is greater than the number of bins, the sorting operation, the stapling operation and the discharging operation are carried out referring to the stacked sheets in all bins and then, the same operations are carried out referring to the rest of the stacked sheets in the bins. Wherein the operations are performed onto all of the set number of copies is completed, the determination at step P59 is YES and then, the program proceeds to step P60, wherein the completion signal is output.

Control of Multistacker

Figure 27:
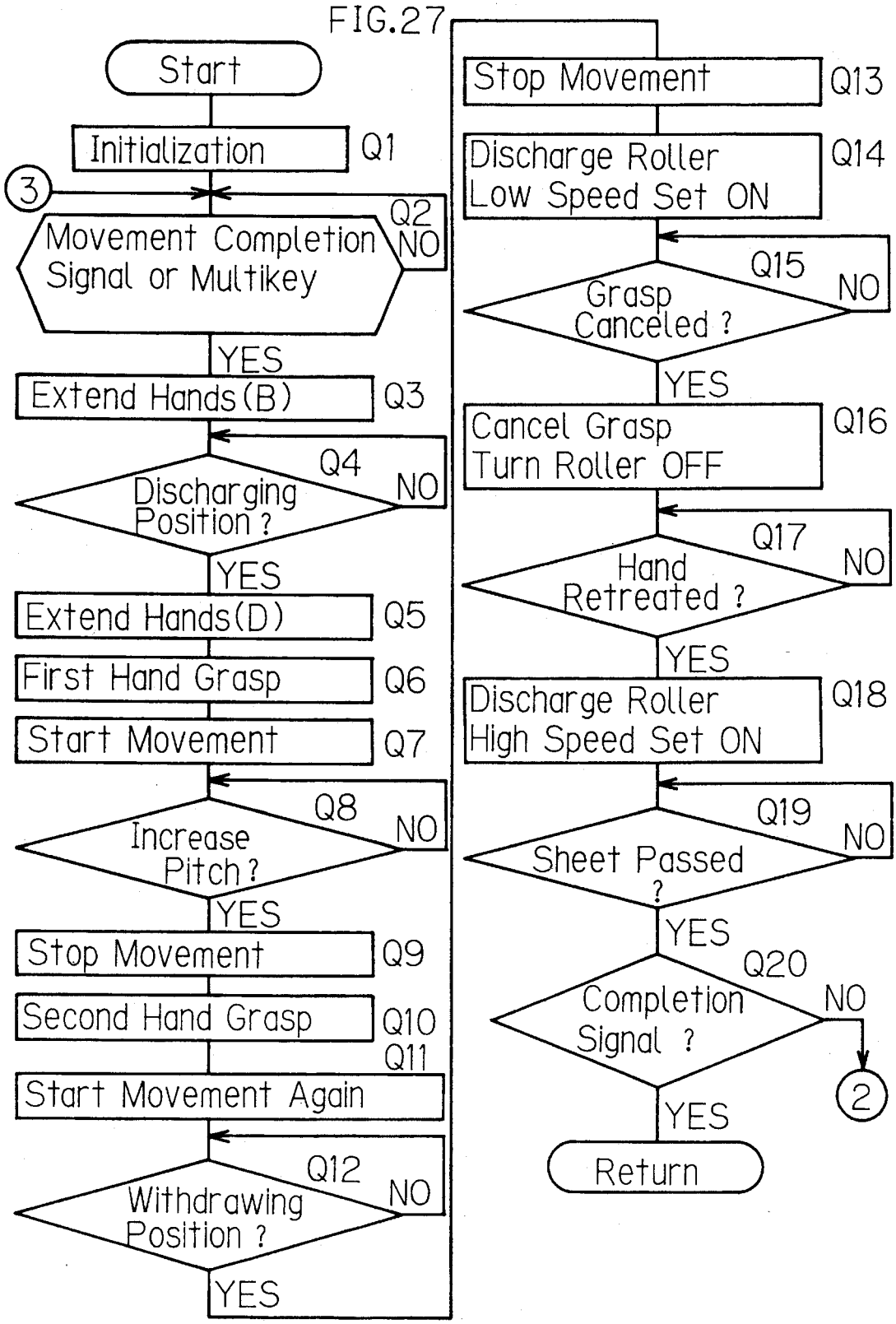
FIG. 27 is a control process flowchart of a multistacker.

FIG. 27 shows a control process flowchart of the multistacker 3.

Figure 29:
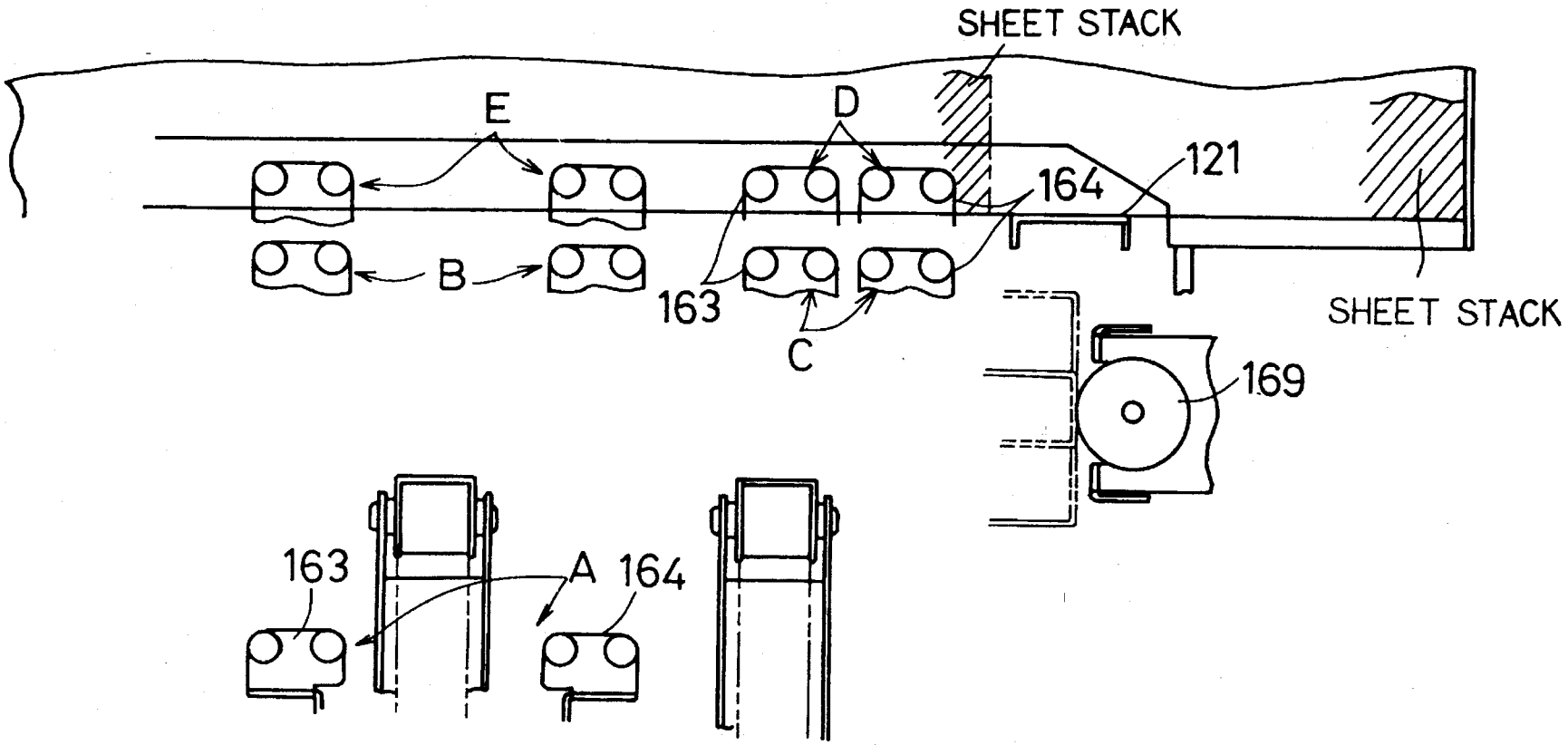
FIG. 29 is a plan view showing a hand mechanism for describing the operation for discharging stacked sheets.

Initialization procedure is carried out at step Q1. In the initialization procedure, for example, the first and second hands 163 and 164 start out at a home position, meaning the moving plate 160 is moved to its home position. Then, it is determined at step Q2 whether the movement completion signal has been output from the sorter control unit 256 or not, or the multikey of the operation panel of the sorter 2 has been pressed or not. Wherein the movement completion signal has been output or the multikey has been pressed, the program proceeds from step Q2 to step Q3. At step Q3, both hands 163 and 164 are extended from the home positions indicated by A in FIG. 29 to a position indicated by B in the figure. At this time, the lower reference member **122*b* of the sorter 2 is lowered and opened. When both hands 163 and 164 are extended, the moving table 160 is moved, whereby both hands 163 and 164 are moved toward the stopper roller 169 and stop at a position indicated by C. Then, it is determined at step Q4 whether the hands 163 and 164 are placed at C position, that is, a position where the stacked sheets are discharged or not. When the hands 163 and 164 are placed at the C position, the program proceeds to step Q5. At step Q5, the hands 163 and 164 are further extended toward the bin 25 to be placed at D position. Throughout these operations the hands 163 and 164 remain in an initial state, the solenoid is off and the upper and lower holding members 180 and 181 are opened (as shown by a one-dotted line in FIG. 17**).

Then, at step Q6, the solenoid 185 of the first hand 163 is turned on and the lateral ends of the stacked sheets are grasped. Then, at step Q7, the moving plate 160 is moved and the first hand 163 is moved in the sheet discharging direction (direction parting from the copying machine body 1). Then, it is determined at step Q8 whether the first hand 163 is apart from the second hand 164 by a predetermined distance or not. The determination is made the sensor 178 which is turned on by the moving first hand 163. At this time, the first hand mounting plate 161 moving with the first hand 163 abuts on the end of the groove of the slide guide 171 fixed to the second hand mounting plate 162. Additionally, at this point of time, the trailing edges of the stacked sheets guided along the fixed reference member 121, thus the trailing edges of the stacked sheets are moved toward the front side of the machine, and the neat stacked sheets are prevented from being disalligned.

When the determination at step Q8 is YES, the program proceeds to step Q9. At step Q9, the movement of the moving plate 160 is once stopped. Then, at step Q10, the solenoid 185 of the second hand 164 is turned on and the trailing edges of the stacked sheets are grasped. Then, step Q11, the moving plate 160 is moved again, and it is determined at step Q12 whether the hands 163 and 164 are placed at a withdrawing position indicated by E in FIG. 29 or not. Wherein the hands 163 and 164 are placed at the E position, the program proceeds to step Q13, wherein the movement of the moving plate 160 is stopped. At step Q14, the hands 163 and 164 are moved toward the front side of the machine to take the stacked sheets out of the bin 25, and the roller units 105 and 106 are moved at low speed in synchronization with the moving speed of the hands 163 and 164. Then, it is determined at step Q15 whether the hands 163 and 164 are placed at a position where the stacked sheets are released or not. The releasing position is the position where the lateral ends of the stacked sheets are nipped by the combination of follower rollers 209 and pressing rollers 211 of the roller units 205 and 206, and is determined when the hands 163 and 164 have been moved a predetermined distance by the motor 190 of the first drive mechanism 165, using a pulse detection device. In addition, this determination may also be made using a photointerrupter 230 for detecting paper jams. When the hands 163 and 164 are placed at the releasing position, the program proceeds to step Q16, wherein the solenoids 185 of the hands 163 and 164 are turned off so that the stacked sheets are released and then, the roller units 205 and 206 are also turned off. Because the hand 164 is freely movable in the lateral direction, and since the hand mechanism 150 is inclined at the same angle of the bin 25, it naturally falls to its laterally original alignment.

The hands 163 and 164 are further retreated toward the front side of the machine, and hand 163 is retracted laterally as well. Then, the guide rollers 170, mounted to the lower end of each of the hands 163 and 164, are guided downward along the guide member 177 and the hands retreat under the sheet transport path 153. It is determined at step Q17 whether each of the hands 163 and 164 is moved to this withdrawn position indicated by the solid line in FIG. 17 or not. When the hands 163 and 164 have reached their respective home positions, the program proceeds to step Q18. At step Q18, in order to discharge the stacked sheets, the roller units 205 and 206 are turned on again to rotate the roller at higher speed than that when the stacked sheets are taken out from the bin. The stacked sheets are further guided along the sheet stack transport path 153 and discharged to the stack portion 152, since the stacked sheets abut on the standing wall 224 of the transport path 153 by means of the elastic member 223, its falling speed is reduced. In addition, the lateral surface 225 of the sheet stack transport path 153 is inclined in the stacked direction of the sheets in transport as shown in FIG. 14, and the bottom surface 226 of the stack portion 152 is also inclined so that the falling sides of the stacked sheets uniformly abut thereon. Thus, an impact when the stacked sheets fall into the stack portion 152 can be relieved, whereby the edges of the falling stacked sheets are prevented from being damaged.

It is determined at step Q19 whether the stacked sheets pass above each of the hands 163 and 164 or not. Wherein the stacked sheets pass above them, the program proceeds to step Q20. It is determined at step Q20 whether the completion signal is output from the sorter control unit 256 or not. Wherein there are stacked sheets in the bin 25 on the sorter 2 side, the program proceeds from step Q20 to step Q21 in FIG. 28. At this step, it is determined whether the stack portion 152 is full or not. If the stack portion 152 is full, preventing further storage of stacked sheets, then the program proceeds from step Q21 to step Q22. At step Q22, a signal for displaying a message to that effect is output to the operation panel 250 of the copying machine body control unit 255. Then, at step Q23, the stop signal is output to the sorter control unit 256 and the copying machine body control unit 255. Thus, an operation of all parts are stopped at once. Then, at step Q24, the stacked sheets are removed from the stack portion 152 and there is a pause until the cancellation signal is output. When the cancellation signal is output, the program returns to step Q2 in FIG. 27 and the above-described operations are repeated. In addition, wherein the determination at step Q21 is YES, the program also returns to step Q2 and the above-described operations are repeated.

If all of the stacked sheets stored in the bins of the sorter 2 are discharged, the completion signal is output from the sorter control unit 256. The determination at step Q20 is YES when the multistacker control unit 257 receives the completion signal, and the multioperation is completed.

By carrying out the multioperation, the processed sheets can be transferred to the stack portion 152 on the front side of the machine from the sorter 2.

Since the hands 163 and 164 are moved in both directions, that is, the lateral direction and the front-to-rear direction of the machine, even when the bins 25 are disposed such that the stacked sheets are positioned behind the cam 33, thereby barring direct removal, the stacked sheets can be smoothly discharged from the bin 25, indirectly using the above avoiding movement. In addition, since the trailing edges of the stacked sheets part from the standing wall **35*a* of the stop gate 35 when the stacked sheets are discharged from the bin 25, the neat stacked sheets are likely to be undone when being withdrawn into the stocker. However, this problem may be avoided primarily because the stacked sheets are grasped by the hands 163 and 164 in this embodiment, and secondarily since the trailing edges of the stacked sheets are grasped by the second hand 164 before they are separated from the reference member 121** which keeps them neatly aligned.

When the stacked sheets are discharged, since the roller units 205 and 206 are rotated at high speed after the hands 163 and 164 are retreated, a timing for starting the next cycle of the hands 163 and 164 can be quickened. Thus, the whole processing time can be shortened.

In addition, the cover **3*a* constituting a part of the sheet transport path 153 is openable and the pressing roller 211 is mounted to the cover 3*a*. Therefore, even when the paper jam is generated at the sheet transport path 153**, an operation for removing the paper can be readily performed.

The stack portion 152 includes an opening 227 on its side, through which the stacked sheets are discharged. Thus, even if the set number of copies is greater than capacity of the stack portion 152, since the operator can easily remove the stacked sheets discharged from the stack portion 152 during the operations, the multioperation can be carried out continuously without stopping the operations because the stack portion 152 has become full.

Figure 28:
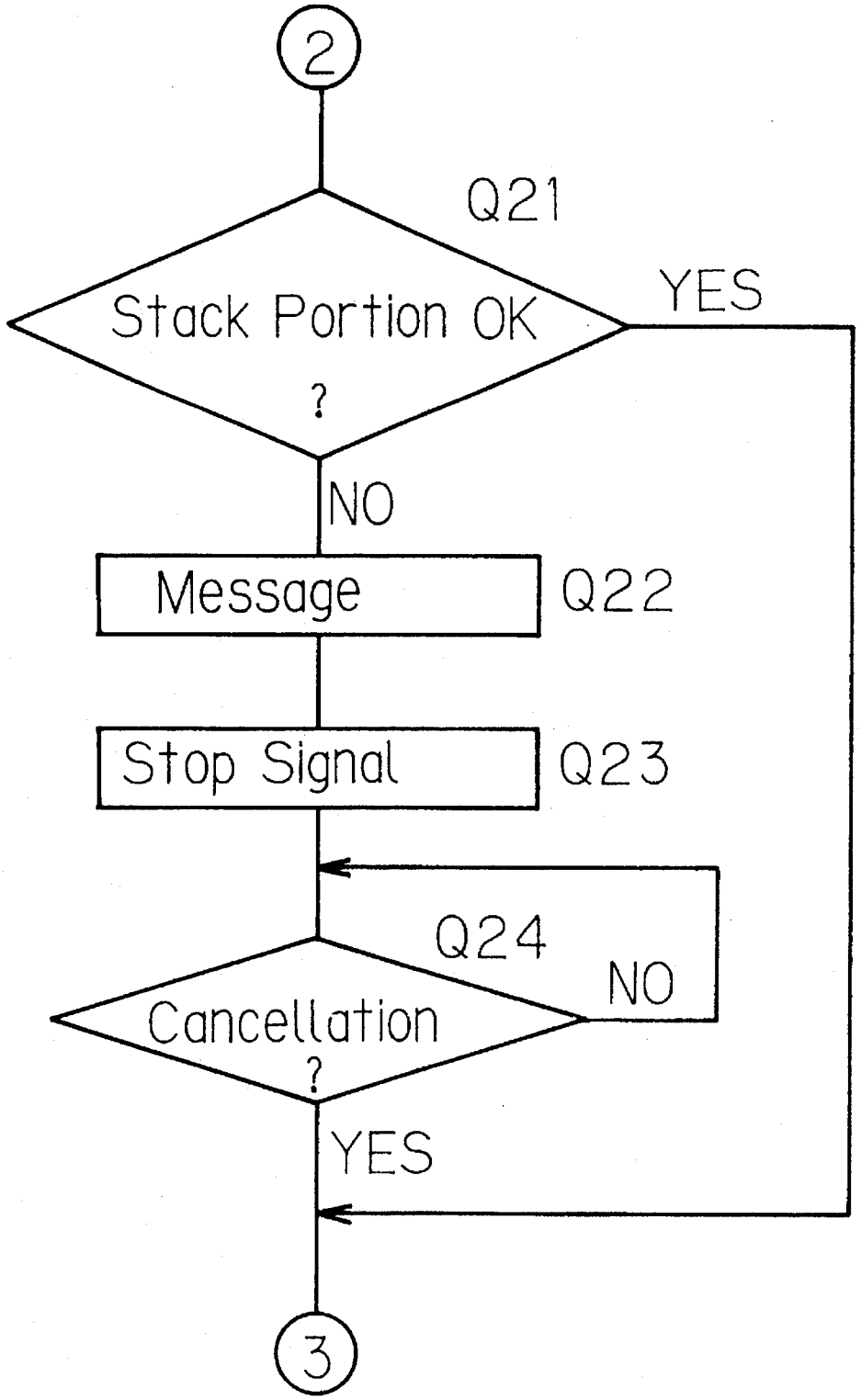
FIG. 28 is a control process flowchart of the multistacker.

In the situation where the set number of copies is equal to or less than the number of bins and the multimode has not set, although the operations has finished and there are processed stacked sheets still left in the bins 25, if the operator presses the multikey in the operation panel 251 of the sorter 2, the remaining stacked sheets will also be discharged to the stack portion 152, by carrying out the operations shown in FIGS. 27 and 28.

[Modification]

(a) Although the cam 33 is used as the driving mechanism of the bins 15 in the above embodiment of the present invention, another mechanism may be used.

(b) The number of hands is not limited to two.

(c) Although the elastic member 223 is fixed to the lower guide 220 in the sheet transport path 153, the elastic member 223 may be fixed to the upper guide 221.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A sheet stack discharging apparatus, comprising:

a multistacker having a body;

a sheet stack storage portion, disposed in a bottom portion of said multistacker body, for storing sheet stacks discharged from a copy sheet sorter of a photocopier wherein copy sheets are transportable in a sheet transport stream through the photocopier and into the sorter;

a sheet stack transport guide disposed in said multistacker body for guiding copy sheet stacks from said copy sheet sorter into said sheet stack storage portion, said sheet stack transport guide at least partially defining a transverse guide path extending transversely to a direction of the sheet transport stream, and said transverse guide path being positioned above said sheet stack storage portion;

a sheet stack grasping mechanism disposed in an upper portion of said multistacker body adjacent said transverse guide path, for grasping a sheet stack from an adjacent bin of a sorting bin unit of said copy sheet sorter and introducing the sheet stack into said transverse guide path, said stack grasping mechanism being retractable into a position beneath said transverse guide path, wherein said stack grasping mechanism is movable in two directions generally orthogonol to each other, one being generally parallel, and the other generally perpendicular, to said sheet transport stream; and a sheet stack discharging mechanism for conveying a sheet stack from said stack grasping mechanism through said transverse guide path.

2. A sheet stack discharging apparatus according to claim 1, wherein said grasping mechanism comprises:

a hand unit moveable in two directions:

a hand unit driving mechanism for driving said hand unit in said two directions.

3. A sheet stack discharging apparatus according to claim 2, wherein said hand unit driving mechanism comprises:

a first driving mechanism for driving said hand unit in a first direction extending width-wise of said discharging apparatus and generally perpendicular to said sheet transport stream, and a second driving mechanism for driving said hand unit in a second direction length-wise of said discharging apparatus, whereby said second direction is a direction in which sheets are discharged from the image forming apparatus to the sorter.

4. A sheet stack discharging apparatus according to claim 3, further comprising a control means for controlling said grasping mechanism in a following sequence of operations:

a first operation driving said hand unit away from an original position toward said sorter, a second operation driving said hand unit away from said image forming apparatus, and a third operation retracting said hand unit back into said discharging mechanism, restoring said hand unit back to said original position.

5. A sheet stack discharging apparatus according to claim 4, wherein said control means controls said hand unit to grasp said stack at a finish of said first operation.

6. A sheet stack discharging apparatus according to claim 5, wherein said control means continues said second operation until said hand unit reaches a predetermined position.

7. A sheet stack discharging apparatus according to claim 6, wherein said control means controls said hand unit to release said stack at a predetermined position during said third operation.

8. A sheet stack discharging apparatus according to claim 7, wherein said original position of said hand unit is away from said transverse guide path, whereby said transverse guide path will not be obstructed.

9. A sheet stack discharging apparatus according to claim 4, wherein said control means controls said stack grasping mechanism in the following sequence of partial-operations during said first operation:

a first partial-operation driving said hand unit toward said sorter;

a second partial-operation driving said hand unit toward said image forming apparatus; and a third partial-operation driving said hand unit further toward said sorter.

10. A sheet stack discharging apparatus according to claim 3, wherein said hand unit is made up of two hands, a first hand and a second hand, said second hand is disposed lateral to said first hand in a direction in which sheets are discharged from said image forming apparatus to the sorter, and said two hands are moveable in said two directions.

11. A sheet stack discharging apparatus according to claim 10, wherein said first hand and said second hand move independent of each other.

12. A sheet stack discharging apparatus according to claim 11, wherein said second driving mechanism drives said first and said second hands independent of each other.

13. A sheet stack discharging apparatus according to claim 12, further comprising a control means for controlling said grasping mechanism in a following sequence of operations:

a first operation driving said first and second hands away from respective original positions toward said sorter, a second operation driving said first hand away from said image forming apparatus, and a third operation retracting said first and second hands back into said discharging mechanism, restoring said first and second hands back to said respective original positions.

14. A sheet stack discharging apparatus according to claim 13, wherein said control means controls said grasping mechanism in the following sequence of partial-operations during said first operation:

a first partial-operation driving said first and second hands toward said sorter;

a second partial-operation driving said first and second hands toward said image forming apparatus; and a third partial-operation driving said first and second hands further toward said sorter.

15. A sheet stack discharging apparatus according to claim 13, wherein said control means:

controls said first hand to grasp said stack at a finish of said first operation; and controls said second hand to grasp said stack during said second operation.

16. A sheet stack discharging apparatus according to claim 15, wherein said control means continues said second operation until said first hand reaches a predetermined position.

17. A sheet stack discharging apparatus according to claim 16, wherein said control means controls said first and second hands to release said stack at a predetermined position during said third operation.

18. A sheet stack discharging apparatus according to claim 17, wherein said respective original positions are away from said transverse guide path, whereby said transverse guide path will not be obstructed.

19. A sheet stack discharging apparatus according to claim 18, wherein said bin of said sorter is inclined at a bin incline angle, and said stack grasping mechanism is aligned to said bin incline angle, whereby said second direction in which said hands are moveable is in line with said bin.

20. A sheet stack discharging apparatus according to claim 3, wherein said sheet stack discharging mechanism comprises:

a roller unit for passing said sheet stack from said hand unit and transporting it into said sheet stack storage portion, having a pair of rollers for receiving said sheet stack therebetween; and a roller driver for driving said roller unit.

21. A sheet stack discharging apparatus according to claim 20, wherein said hand unit is made up of two hands, a first hand and a second hand, said second hand is disposed lateral to said first hand in the direction of said sheet transport steam, and said two hands are moveable in said two directions.

22. A sheet stack discharging apparatus according to claim 21, wherein said first hand and said second hand move independent of each other.

23. A sheet stack discharging apparatus according to claim 22, further comprising a control means for controlling said grasping mechanism in a following sequence of operations:

a first operation driving said first and second hands away from respective original positions toward said sorter, a second operation driving said first hand away from said image forming apparatus, and a third operation retracting said first and second hands back into said multistacker body, restoring said first and second hands back to said respective original positions.

24. A sheet stack discharging apparatus according to claim 23, wherein said control means further controls said roller driver of said discharging mechanism to drive said roller unit at two speeds, whereby a first speed of said two speeds is slower than a second speed of said two speeds.

25. A sheet stack discharging apparatus according to claim 24, wherein said control means controls said first and second hands to release said stack at a predetermined position during said third operation.

26. A sheet stack discharging apparatus according to claim 25, wherein said respective original positions are away from said transverse guide path, whereby said transverse guide path will not be obstructed.

27. A sheet stack discharging apparatus according to claim 26, wherein said control means controls said roller driver to rotate said roller unit at said first speed throughout said third operation, and to rotate said roller unit at said second speed thereafter until said stack is transported out of said discharging mechanism.

28. A sheet stack discharging apparatus according to claim 23, wherein said control means controls said grasping mechanism in the following sequence of partial-operations during said first operation:

a first partial-operation driving said first and second hands toward said sorter;

a second partial-operation driving said first and second hands toward said image forming apparatus; and a third partial-operation driving said first and second hands further toward said sorter.

29. A sheet stack handling apparatus, comprising:

a multistacker dimensioned and arranged for functioning in a position operationally in front of a copy sheet sorter associated with an image forming apparatus, said multistacker having a box-like hollow body containing a bottom sheet stack storage area for storing sheet stacks discharged from a copy sheet sorter sorting bin unit; and a sheet stack handling mechanism disposed above the sheet stack storage area for grasping a sheet stack from an adjacent sorting bin of said copy sheet sorter and discharging the sheet stack into said sheet stack storage area, said sheet stack handling mechanism including a handling unit shiftable in two directions generally orthogonal to each other, one of said two directions being generally parallel with said adjacent sorting bin, and a handling unit driving mechanism for driving said handling unit in either of said two directions.

30. A sheet stack handling apparatus according to claim 29, wherein said handling unit driving mechanism comprises:

a first driving mechanism for driving said handling unit in a first direction width-wise of said stack handling apparatus, and a second driving mechanism for driving said handling unit in a second direction length-wise of said stack handling apparatus, whereby said second direction is a direction in which sheets are discharged from said image forming apparatus to said sorter.

31. A stack handling discharging apparatus according to claim 30, wherein said handling unit is made up of two hands, a first hand and a second hand, said second hand is disposed lateral to said first hand in the second direction, and said two hands are moveable in said two directions.

32. A sheet stack handling apparatus according to claim 31, wherein said first hand and said second hand move independent of each other.

33. A sheet stack handling apparatus according to claim 32, wherein said second driving mechanism drives said first hand independent of said second hand in said second direction.

34. A sheet stack handling apparatus according to claim 33, further comprising a control means for controlling said handling unit and said handling unit driving mechanism in a following sequence of operations:

a first operation driving said first and second hands away from respective original positions toward said sorter, a second operation driving said first hand away from said image forming apparatus, and a third operation retracting said first and second hands back into said multistacker, restoring said first and second hands back to said respective original positions.

35. A sheet stack handling apparatus according to claim 34, wherein said control means:

controls said first hand to grasp said stack at a finish of said first operation; and controls said second hand to grasp said stack during said second operation.

36. A sheet stack handling apparatus according to claim 35, wherein said control means continues said second operation until said first hand reaches a predetermined position.

37. A sheet stack handling apparatus according to claim 36, wherein said control means controls said first and second hands to release said stack at a predetermined position during said third movement.

38. A sheet stack handling apparatus according to claim 37, further comprising a sheet stack transport guide disposed in said body and at least partially defining a guide path extending transverse to the second direction and wherein said respective original positions of said first and second hands are below and away from said guide path, whereby said guide path is unobstructed.

39. A sheet stack handling apparatus according to claim 38, wherein said bin of said sorter is inclined at a bin incline angle, and said grasping mechanism is aligned to said bin incline angle, whereby said second direction in which said hands are moveable is in line with said bin.

40. A sheet stack handling apparatus according to claim 34, wherein said control means controls said handling unit driving mechanism and said handling unit in the following sequence of partial-operations during said first operation:

a first partial-operation driving said handling unit toward said sorter;

a second partial-operation driving said handling unit toward said image forming apparatus; and a third partial-operation driving said handling unit further toward said sorter.

41. A sheet stack handling apparatus, comprising:

a multistacker having a body;

a sheet stack storage portion, disposed in a bottom portion of the multistacker body, for storing sheet stacks discharged from a copy sheet sorter of a photocopier wherein copy sheets are transportable in a sheet transport stream through the photocopier and into the sorter;

a sheet stack transport guide disposed in said multistacker body for guiding copy sheet stacks from said copy sheet sorter into said sheet stack storage portion, said sheet stack transport guide at least partially defining a transverse guide path extending transversely to a direction of the sheet transport stream, and said transverse guide path being positioned above said sheet stack storage portion;

a sheet stack grasping mechanism disposed in an upper portion of said multistacker body adjacent said transverse guide path, for grasping a sheet stack from an adjacent bin of a sorting bin unit of said copy sheet sorter and introducing the sheet stack into said transverse guide path, said sheet stack grasping mechanism including a hand unit shiftable in two directions generally orthogonal to each other, one of said two directions being generally perpendicular to said sheet transport stream, and a hand unit driving mechanism for driving said hand unit in either of said two directions, and for retracting said sheet stack grasping mechanism into, and withdrawing said sheet stack grasping mechanism from, a position beneath said transverse guide path; and a sheet stack discharging mechanism for conveying a sheet stack from said stack grasping mechanism through said transverse guide path.

* * * * *